US012060772B2

(12) United States Patent
Gillis et al.

(10) Patent No.: US 12,060,772 B2
(45) **Date of Patent: *Aug. 13, 2024**

(54) SYSTEMS AND METHODS FOR PRODUCING HYDROCARBON MATERIAL FROM OR INJECTING FLUID INTO A SUBTERRANEAN FORMATION USING ADJUSTABLE FLOW RESTRICTION

(71) Applicant: NCS Multistage, Inc., Calgary (CA)

(72) Inventors: Brock Gillis, Calgary (CA); Juan Montero, Calgary (CA); Jonathan Raasch, Calgary (CA)

(73) Assignee: NCS MULTISTAGE INC., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/095,365

(22) Filed: Jan. 10, 2023

(65) Prior Publication Data

US 2023/0144473 A1 May 11, 2023

Related U.S. Application Data

(63) Continuation of application No. 17/247,076, filed on Nov. 27, 2020, now Pat. No. 11,578,562.

(51) Int. Cl.
*E21B 34/14* (2006.01)
*E21B 43/12* (2006.01)

(52) U.S. Cl.
CPC ..... *E21B 34/14* (2013.01); *E21B 43/12* (2013.01); *E21B 2200/06* (2020.05)

(58) Field of Classification Search
CPC ..... E21B 33/04; E21B 33/035
See application file for complete search history.

(56) References Cited

U.S. PATENT DOCUMENTS

| | | | |
|---|---|---|---|
| 5,896,928 | A | 4/1999 | Coon |
| 7,467,658 | B2 | 12/2008 | Kent et al. |
| 10,161,207 | B2 | 12/2018 | Ravensbergen et al. |
| 10,180,046 | B2 | 1/2019 | Werries et al. |
| 10,689,950 | B2 * | 6/2020 | Johnson ..... E21B 34/14 |
| 2016/0201431 | A1 | 7/2016 | Castillo et al. |

FOREIGN PATENT DOCUMENTS

| | | | |
|---|---|---|---|
| WO | 2016026024 | A1 | 2/2016 |
| WO | 2018049533 | A1 | 3/2018 |
| WO | 2018161158 | A1 | 9/2018 |

* cited by examiner

*Primary Examiner* — Aaron L Lembo
(74) *Attorney, Agent, or Firm* — Nolte Lackenbach Siegel

(57) ABSTRACT

A valve assembly for integration within a wellbore string disposed within a subterranean reservoir is provided. The valve assembly includes a valve housing having one or more injection ports for establishing fluid communication between a central passage and the reservoir. The valve assembly includes a valve sleeve operatively mounted within the valve housing and comprising a fluid channel adapted to establish fluid communication between the central passage and the injection ports, and configured to create a fluid flowrate restriction. The valve assembly has a flow adjuster connectable to the valve sleeve, and is selectively arranged to align an opening with the fluid channel and allow fluid to flow from the fluid channel through the opening to the injection port, wherein connecting the flow adjuster to the valve sleeve defines a flow length of the fluid channel to adjust the fluid restriction created by the fluid channel.

28 Claims, 12 Drawing Sheets

SYSTEMS AND METHODS FOR PRODUCING HYDROCARBON MATERIAL FROM OR INJECTING FLUID INTO A SUBTERRANEAN FORMATION USING ADJUSTABLE FLOW RESTRICTION

CROSS REFERENCE TO RELATED APPLICATION

The present application is a continuation to U.S. application Ser. No. 17/247,076 filed Nov. 27, 2020, the contents of all of which are incorporated by reference herein in their entirety.

TECHNICAL FIELD

The present disclosure relates to systems and methods for producing hydrocarbon material from a subterranean formation and injecting fluid into a formation, and more particularly to a valve deployable in a well and having an adjustable flow restriction.

BACKGROUND

Over the lifetime of a well, various processes may be implemented for producing hydrocarbon material from or injecting fluid into a subterranean formation. Current well completions have various drawbacks to accommodate such different processes.

SUMMARY

According to a first aspect, there is provided a valve assembly for integration within a wellbore string disposed within a subterranean reservoir. The valve assembly includes a valve housing comprising a tubular wall defining a central passage therethrough and one or more injection ports extending through the tubular wall for establishing fluid communication between the central passage and the reservoir; a valve sleeve operatively mounted within the valve housing and comprising a fluid channel adapted to establish fluid communication between the central passage and the injection ports, the fluid channel being shaped and configured to create a fluid flowrate restriction between the central passage and the injection ports; and a flow adjuster connectable to the valve sleeve and comprising an opening, the flow adjuster being selectively arranged relative to the valve sleeve to align the opening with a portion of the fluid channel and allow fluid to flow from the fluid channel through the opening to the injection port, wherein connecting the flow adjuster to the valve sleeve defines a flow length of the fluid channel to adjust the fluid flowrate restriction created by the fluid channel.

According to a possible implementation, the fluid channel comprises a groove defined in an outer surface of the valve sleeve, the groove being shaped and configured to create the flowrate restriction.

According to a possible implementation, the groove is boustrophedonically shaped.

According to a possible implementation, the groove extends circumferentially around at least part of the valve sleeve.

According to a possible implementation, the fluid channel comprises a channel inlet section including at least one inlet opening defined in an inner surface of the valve sleeve, the at least one inlet opening being in fluid communication with the groove, and wherein the opening of the flow adjuster defines an outlet opening to establish fluid communication between the groove and one or more of the injection ports.

According to a possible implementation, the fluid channel includes an inlet chamber defined in the outer surface of the valve sleeve, the inlet chamber being in fluid communication with the groove and being sized and configured to mitigate intake of undesired material into the groove.

According to a possible implementation, he inlet opening includes one or more slots shaped and configured to prevent oversized material from entering the fluid channel.

According to a possible implementation, the one or more slots open into the inlet chamber.

According to a possible implementation, the groove comprises a first groove portion in fluid communication with the inlet chamber and a second groove portion in fluid communication with the first groove portion, and wherein fluid flows along the first groove portion in a first circumferential direction, and wherein fluid flows along the second groove portion in a second circumferential direction.

According to a possible implementation, the first groove portion and the second groove portion are substantially symmetrical to one another.

According to a possible implementation, the first circumferential direction is generally clockwise around the circumference of the valve sleeve, and wherein the second circumferential direction is counterclockwise around the circumference of the valve sleeve.

According to a possible implementation, the flow adjuster comprises a sleeve cap adapted to be coupled to the valve sleeve and cover the groove of the fluid channel but for the opening communicating therewith.

According to a possible implementation, the outlet opening is defined through a thickness of the sleeve cap, and wherein the fluid channel establishes fluid communication between the central passage and the injection ports, via the outlet opening, upon coupling the sleeve cap to the valve sleeve and aligning the opening with respect to a location along the fluid channel.

According to a possible implementation, the flow length of the fluid channel is defined by a length of the groove extending between the inlet opening and the outlet opening.

According to a possible implementation, the sleeve cap is substantially tubular or ring-shaped.

According to a possible implementation, the groove is located at a downhole end of the valve sleeve, and wherein the sleeve cap is configured to be coupled to and cover the downhole end of the valve sleeve.

According to a possible implementation, the downhole end of the valve sleeve is inset and has an outer diameter substantially the same or smaller than an inner diameter of the sleeve cap.

According to a possible implementation, the sleeve cap comprises an outlet groove extending on either side of the outlet opening to enable fluid flow therealong, and wherein the outlet groove is adapted to be positioned opposite the injection ports to provide fluid communication therewith.

According to a possible implementation, the sleeve cap is adapted to be coupled to the valve sleeve in a plurality of predetermined positions to define respective lengths of the groove and corresponding fluid flowrate restrictions.

According to a possible implementation, each one of the predetermined positions corresponds to a radial position of the sleeve cap relative to the valve sleeve.

According to a possible implementation, the radial positions of the sleeve cap are evenly radially spaced apart from one another to align with respective portions of the fluid channel.

According to a possible implementation, the valve assembly further comprises an alignment device configured to facilitate alignment of the sleeve cap with the valve sleeve to align the opening with a portion of the fluid channel and establish fluid communication between the central passage and the injection ports at a desired flow restriction.

According to a possible implementation, the alignment device comprises a tubular body adapted to removably receive the valve sleeve and the sleeve cap therein, and markers configured to indicate a position of the valve sleeve and a position of the sleeve cap relative to the tubular body.

According to a possible implementation, the markers comprise apertures defined through the tubular body configured to indicate an axial position and a radial position of the valve sleeve relative to the tubular body, and a radial position of the sleeve cap relative to the tubular body and the valve sleeve.

According to a possible implementation, the markers are configured to align with respective components of the valve sleeve and/or sleeve cap within the tubular body.

According to a possible implementation, the markers comprise at least one of an inlet chamber marker, a groove section marker, a lip marker and an outlet opening marker.

According to a possible implementation, the alignment device is configured for removal prior to deployment of the valve assembly into the subterranean reservoir.

According to a possible implementation, the valve sleeve is slidable between a closed position and an open position.

According to a possible implementation, the valve sleeve is fixed relative to the valve housing.

According to a possible implementation, the valve assembly further comprises a second valve sleeve mounted within the valve housing.

According to another aspect, there is provided an alignment device for positioning a flow adjuster provided with an opening relative to a valve sleeve provided with a fluid channel. The alignment device comprising a body defining an interior volume for receiving therein the valve sleeve and the flow adjuster; and a plurality of apertures provided along the body, the plurality of apertures being configured to indicate respective positions of the valve sleeve relative to the body and to indicate respective positions of the flow adjuster relative to the valve sleeve.

According to a possible implementation, the body is tubular, and wherein the plurality of apertures are adapted to indicate at least one of a radial position and an axial position of the valve sleeve relative to the tubular body, and wherein the plurality of apertures are adapted to indicate a radial position of the flow adjuster relative to the valve sleeve.

According to a possible implementation, the alignment device is configured to align the opening at a position along the fluid channel which is defined by a groove extending circumferentially around the valve sleeve and comprises an inlet section.

According to a possible implementation, the alignment device is configured to align the opening at a position along the groove which comprises a first groove portion extending circumferentially around the valve sleeve in a first direction, and a second groove portion extending circumferentially around the valve sleeve in a second direction.

According to a possible implementation, the alignment device is configured to axially align the flow adjuster with the valve sleeve which comprises an inset section and a lip defining an abutment surface, the groove extending along the inset section of the valve sleeve, such that the flow adjuster abuts on the lip of the valve sleeve.

According to a possible implementation, the plurality of apertures comprises at least one of: one or more groove apertures configured to align with corresponding segments of the groove; an inlet section aperture configured to align with the inlet section of the fluid channel; and one or more lip apertures configured to align with the lip of the valve sleeve; and wherein the groove apertures, inlet section aperture and lip apertures are configured to indicate the position of the valve sleeve relative to the alignment device.

According to a possible implementation, the plurality of apertures comprises a plurality of outlet apertures, and wherein the outlet apertures are shaped and adapted to align with the opening of the flow adjuster when coupling the flow adjuster to the valve sleeve such that the flow adjuster is selectively positioned relative to the valve sleeve.

According to a possible implementation, the outlet apertures are radially spaced apart about an end of the body and are open-ended.

According to a possible implementation, the alignment device is configured to facilitate positioning the flow adjuster to cover the inset section of the valve sleeve and abut with the abutment surface when coupled to the valve sleeve.

According to another aspect, there is provided a method comprising injecting a fluid via a wellbore string having a plurality of the valve assemblies as defined above, into a subterranean formation at a restricted fluid flowrate.

According to a possible implementation, the method comprises selectively connecting the flow adjusters of respective valve assemblies to the respective valve sleeves in predetermined position to create desired fluid flow restrictions at different locations along the wellbore string.

According to a possible implementation, the fluid flow restrictions of the valve assemblies installed in an uphole region of the wellbore string are greater than the fluid flow restrictions of the valve assemblies installed in a downhole region of the wellbore string.

According to a possible implementation, the method further comprises operating the wellbore string as part of a frac-to-frac hydrocarbon recovery process, a huff-and-puff hydrocarbon recovery process, a flooding hydrocarbon recovery process, a geothermal process, or a solution mining process.

According to yet another aspect, there is provided a valve assembly for integration within a wellbore string disposed within a subterranean reservoir. The valve assembly comprising: a valve housing comprising a tubular wall defining a fluid passage allowing fluid to flow through the housing, and comprising a fluid port defined radially through the tubular wall and being in fluid communication with an external environment of the valve housing; a flow restriction component having an first end provided with an first opening in fluid communication with the fluid passage and a second end adapted to be in fluid communication with the fluid port, the flow restriction component being configured to create a fluid flowrate restriction such that fluid flowrate between the fluid passage and the fluid port is restricted; a flow adjuster having an opening and configured to cooperate with the flow restriction component such that positioning the opening defines a flow restriction of the flow restriction component.

According to a possible implementation, the flow restriction component comprises an elongated fluid channel.

According to a possible implementation, the elongated fluid channel extends circumferentially around at least part of the valve assembly.

According to a possible implementation, the elongated fluid channel comprises a boustrophedonic pattern.

According to a possible implementation, the valve assembly further comprises a valve sleeve operatively connected with the valve housing, and wherein the elongated fluid channel is defined by a groove provided in a surface of the valve sleeve and a corresponding opposed surface of the housing.

According to a possible implementation, the valve sleeve is located within the housing, the groove is defined in an outer surface of the valve sleeve, and the opposed surface of the housing is an inner surface of the housing.

According to a possible implementation, the valve sleeve is fixedly connected with respect to the valve housing.

According to a possible implementation, the valve sleeve is slidably connected within the valve housing and slidable within the fluid passage between a first configuration where the valve sleeve is axially spaced from the fluid port, and a second position where the valve sleeve overlays the fluid port to enable fluid communication between the fluid passage and the injection port via the fluid channel.

According to a possible implementation, the valve sleeve is a top sleeve, and wherein the valve assembly further comprises a bottom sleeve slidably connected within the valve housing and slidable within the fluid passage between a closed position, where the bottom sleeve occludes the injection port, and an open position, where the bottom sleeve is axially spaced from the injection port to open the fluid port and establish fluid communication between the fluid passage and the external environment of to the valve housing.

According to a possible implementation, the flow restriction component and the flow adjuster are configured so that the opening is alignable with respect to a plurality of positions to define different flow lengths by rotation of the flow adjuster about a longitudinal axis of the valve assembly.

According to a possible implementation, the flow adjuster comprises a tubular body and the opening is provided through a wall thickness of the tubular body, and wherein the tubular body is axially positionable within the housing for axial alignment with respect to the flow restriction component and radially positionable to align the opening to provide a corresponding flow length.

According to a possible implementation, the flow restriction component is configured such that, upon rotation of the flow adjuster, the opening is alignable with one of a plurality of fluid communication regions or one of a plurality of blockage regions.

According to a possible implementation, the flow restriction component and the flow adjuster are configured so that the opening aligns with the second end to define an outlet opening to provide fluid communication between the first end and the fluid port.

According to a possible implementation, the flow adjuster comprises a single opening.

According to another aspect, there is provided a kit, comprising: at least two valve assemblies as defined above, wherein the at least two valve assemblies comprise components that are identical to each other; wherein a first valve assembly is configured such that the flow adjuster is positioned to define a first flow restriction; and wherein a second valve assembly is configured such that the flow adjuster is positioned to define a second flow restriction different from the first.

According to another aspect, there is provided a well completion system, comprising: a plurality of valve assemblies, each comprising: a housing having a port; a valve sleeve withing the housing and provided with a tortuous fluid channel; a flow adjuster comprising an opening, the flow adjuster being configured to be couplable to the valve sleeve to selectively align the opening at a location along the tortuous fluid channel to define a corresponding flow length and flow restriction of the tortuous fluid channel; a plurality of conduits connecting the valve assemblies in spaced-apart relation along a wellbore provided in a subterranean formation, the conduits being configured for fluid communication to and/or from the valve assemblies.

According to a possible implementation, one or more of the valve assemblies are as defined above.

According to another aspect, a valve assembly for integration within a wellbore string disposed within a subterranean reservoir is provided. The valve assembly includes a valve housing comprising a tubular wall defining a fluid passage allowing fluid to flow through the housing, and comprising a fluid port defined radially through the tubular wall and being in fluid communication with an external environment of the valve housing; a valve sleeve operatively mounted within the valve housing and comprising a fluid channel having a channel inlet and being adapted to establish fluid communication between the fluid passage and the fluid port, the valve sleeve being selectively positioned within the fluid passage to align a portion of the fluid channel with the fluid port to define a flow length between the channel inlet and the fluid port, the channel being shaped and configured to create a fluid flowrate restriction along the flow length.

According to a possible implementation, the fluid channel comprises a groove defined in an outer surface of the valve sleeve, and wherein a portion of the groove is adapted to be aligned with the fluid port of the valve housing.

According to a possible implementation, the groove is boustrophedonically shaped to create the fluid flowrate restriction.

According to a possible implementation, the groove extends circumferentially around at least part of the valve sleeve.

According to a possible implementation, the channel inlet comprises at least one inlet opening defined in an inner surface of the valve sleeve, the at least one inlet opening being in fluid communication with the groove, and wherein the channel comprises a channel outlet defined by the portion of the groove aligned with the fluid port.

According to a possible implementation, the fluid channel includes an inlet chamber defined in the outer surface of the valve sleeve, the inlet chamber being in fluid communication with the groove and being sized and configured to mitigate intake of undesired material into the groove.

According to a possible implementation, the inlet opening includes one or more slots shaped and configured to prevent oversized material from entering the fluid channel.

According to a possible implementation, the one or more slots open into the inlet chamber.

According to a possible implementation, the groove comprises a first groove portion in fluid communication with the inlet chamber and a second groove portion in fluid communication with the first groove portion, and wherein fluid flows along the first groove portion in a first circumferential direction, and wherein fluid flows along the second groove portion in a second circumferential direction.

According to a possible implementation, the first groove portion and the second groove portion are substantially symmetrical to one another.

According to a possible implementation, the first circumferential direction is generally clockwise around the circumference of the valve sleeve, and wherein the second circumferential direction is counterclockwise around the circumference of the valve sleeve.

According to a possible implementation, the valve housing comprises an inner surface adapted to cover the groove of the fluid channel but for the portion communicating with the fluid port.

According to a possible implementation, the valve sleeve is adapted to be mounted within the valve housing in a plurality of predetermined positions to define respective lengths of the groove and corresponding fluid flowrate restrictions.

According to a possible implementation, each one of the predetermined positions corresponds to a radial position of the valve sleeve relative to the valve housing.

According to a possible implementation, the radial positions of the valve sleeve are evenly radially spaced apart from one another to align respective portions of the groove with the fluid port.

According to a possible implementation, the valve sleeve is slidable between a closed position and an open position.

According to a possible implementation, the valve assembly further comprises a second valve sleeve mounted within the valve housing.

DETAILED DESCRIPTION

As will be explained below in relation to various implementations, the present disclosure describes systems and methods for various in situ operations, such as the injection of fluids into subterranean reservoirs, using a valve assembly configured for providing an adjustable flow restriction. The valve assembly can be integrated as part of a wellbore string and operable between various configurations for allowing fluid to be injected into the reservoir with a predetermined flow restriction that can be adjusted prior to deploying the valve assembly. In example implementations, the valve assembly includes a valve sleeve provided with a fluid channel extending between the wellbore string and the reservoir and providing flow restriction, for example due to its tortuous path. The valve assembly also includes a flow adjuster having an opening and configured to be coupled to the valve sleeve to align with a part of the fluid channel to define its length and thus provide a certain level of flow restriction through the channel and into the reservoir. The flow adjuster therefore cooperates with the flow restriction component of the sleeve in order to provide the desired flow resistance for the given application, such as fluid injection into the formation.

Broadly described, the present application relates to a valve assembly, and more specifically to an adjustable flow restriction to vary the fluid flow that can pass through the valve. In some implementations, the valve assembly includes a flow adjuster configured to be coupled to the sleeve of the valve assembly to adjust the flow restriction component. The housing of the valve assembly can be a tubular housing, with the valve sleeve being installed within the housing. The valve sleeve includes the fluid channel, with an inlet of the fluid channel being provided on an inner surface of the valve sleeve and opening into a groove defined along an outer surface of the valve sleeve. The flow adjuster can be configured to be coupled to the valve sleeve, and comprises an opening which is shaped, sized and configured to overlay the groove at one of various locations along a length of the groove. As such, the length of the fluid channel (i.e., the length defined between the inlet and the outlet) can be adjusted, and the flowrate of fluid into the reservoir can be controlled.

Figure 1:
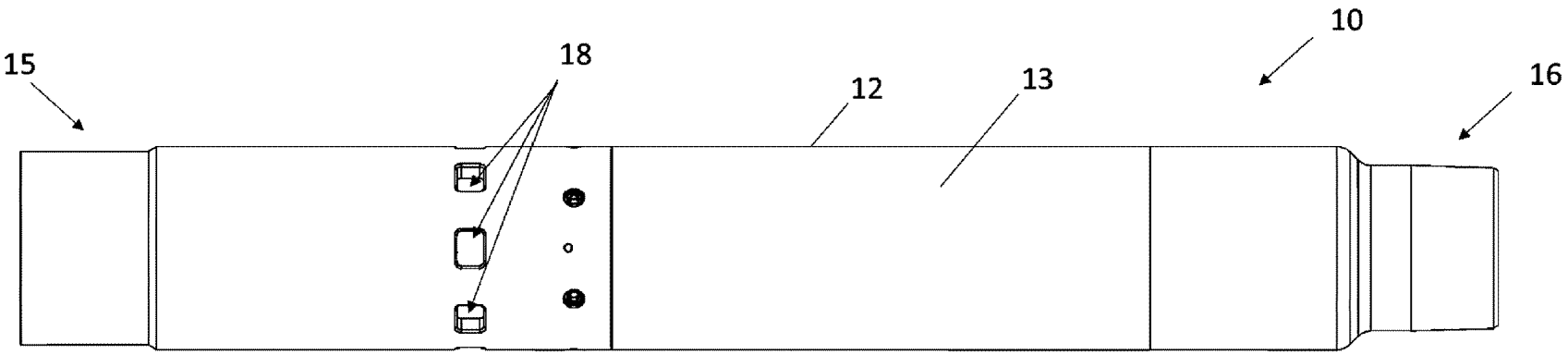
FIG. 1 is a side view of an implementation of a valve assembly.
Figure 2:
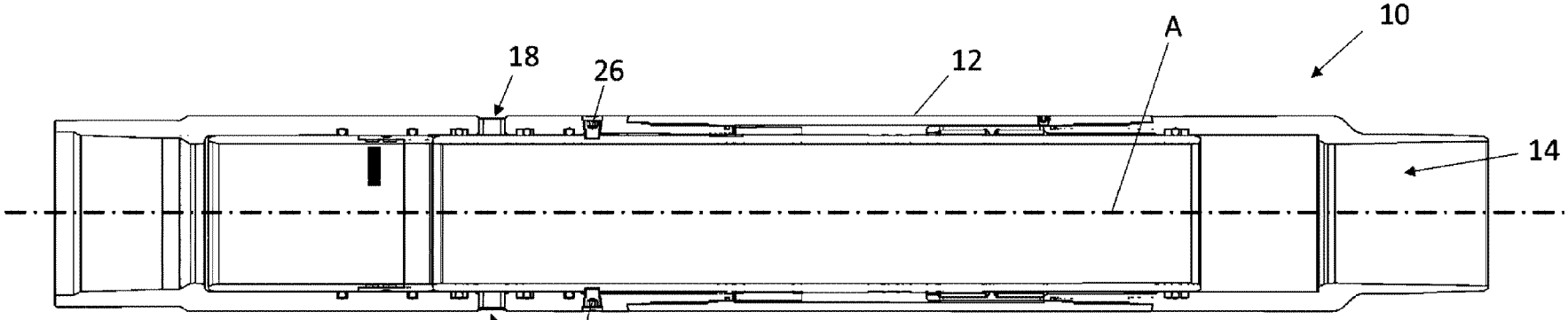
FIG. 2 is a transverse cut view of the valve assembly shown in FIG. 1, showing a pair of valve sleeve mounted within a housing of the valve assembly, according to an implementation.

With reference to FIGS. 1 and 2, an example implementation of the valve assembly 10 is illustrated. As mentioned above, the valve assembly 10 includes a valve housing 12 having a tubular wall 13 defining a central passage 14 for allowing fluid to flow therethrough. The valve housing 12 has an uphole end 15 and a downhole end 16 adapted to be connected between lengths of conduits in order to integrate the valve assembly within a wellbore string. It is noted that the conduits are not illustrated in the figures, but would be located on either end of the valve assembly 10 and can be coupled to respective ends of the valve housing 12 by various methods.

It should be understood that, as used herein, the expressions "uphole" and "downhole" refer to directional/orientational expressions using the configuration of the wellbore as reference. More specifically, the uphole direction is generally the direction leading to the surface, and the downhole direction is generally the direction leading away from the surface. Moreover, with reference to FIGS. 1 to 5, the uphole direction is generally towards the left, while the downhole direction is generally towards the right.

The valve housing 12 is provided with one or more injection ports 18 extending radially about the valve housing 12. In this implementation, the injection ports 18 extend through the valve housing 12 (e.g., through a thickness of the tubular wall 13) for establishing fluid communication with the surrounding reservoir. It is appreciated that the valve housing 12 can include any suitable number of injection ports 18 positioned in any suitable configuration. For example, in this illustrated implementation, the valve housing 12 includes eight (8) injection ports 18 aligned at an axial location along the valve housing 12, and distributed about the tubular wall 13 at generally regular intervals (i.e., separated by 45 degree angles). The injection ports 18 can also have various cross-sectional areas and shapes, e.g., cylindrical, frustoconical, tapered toward or away from the reservoir, rectangular with or without bevelled edges, etc. It should also be noted that the valve housing 12 can be provided with a single injection port 18 instead of several.

Figure 3:
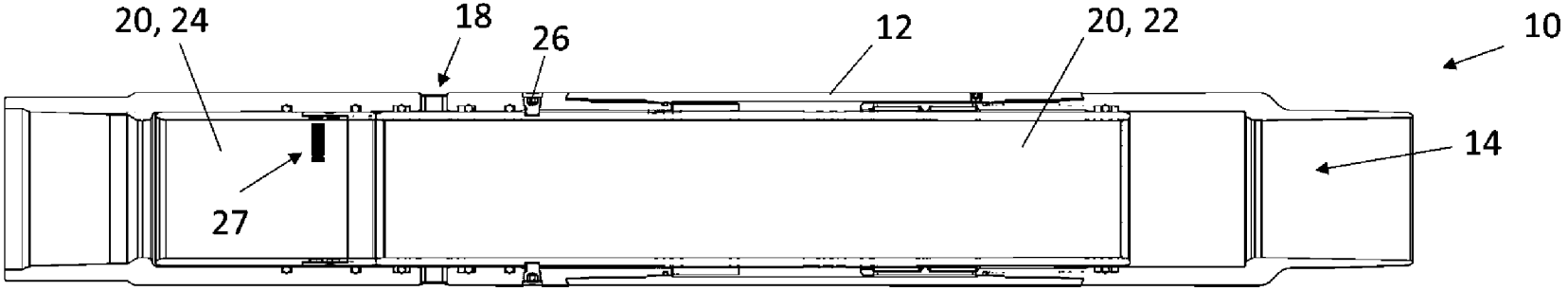
FIGS. 3 to 5 are transverse cut views of the valve assembly shown in FIG. 1, showing the valve assembly in a closed configuration (FIG. 3), an open configuration (FIG. 4) and a restricted configuration (FIG. 5), according to possible implementations.
Figure 4:
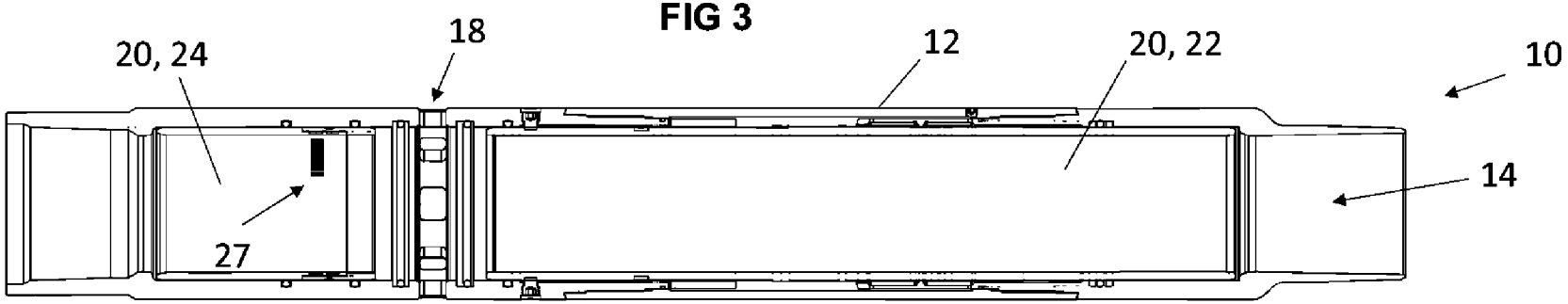
Figure 5:
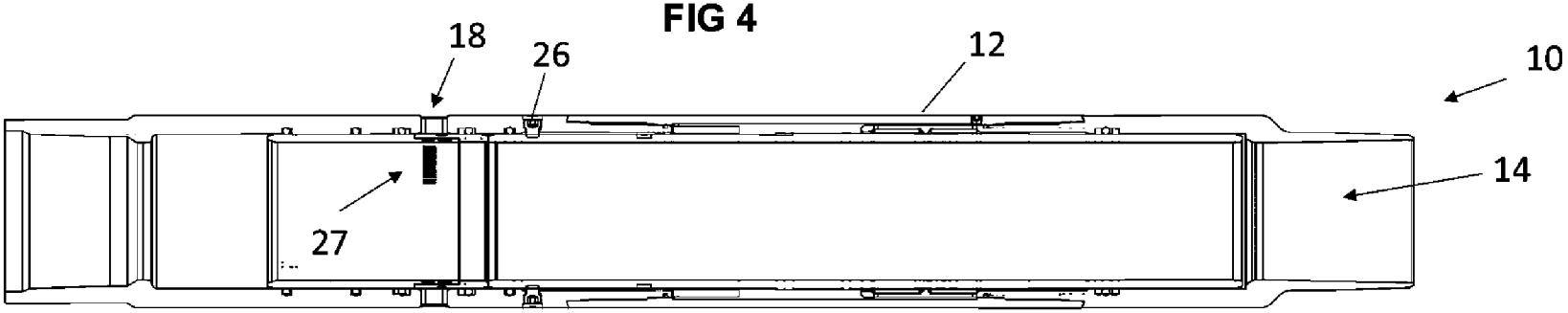

Now referring to FIGS. 3 to 5, in addition to FIGS. 1 and 2, the valve assembly 10 can be configurable between a closed configuration, where the injection ports 18 are occluded to prevent fluid flow therethrough and an open configuration, where at least one of the injection ports 18 is partially open or fully open. It is appreciated that in the open configuration, the valve assembly 10 enables fluid to flow through the one or more injection ports 18 and into the reservoir, therefore allowing fluids to be injected into the reservoir. In this implementation, the valve assembly 10 includes one or more valve sleeves 20 configured to operate between the closed and open configurations via a displacement of the valve sleeves 20 within the valve housing 12.

Still referring to FIGS. 3 to 5, the valve sleeves 20 can be operatively mounted within the valve housing 12 for selectively closing and opening the injection ports 18. In this implementation, the valve sleeves 20 include a pair of valve sleeves slidably mounted within the housing 12 for moving axially therealong, e.g., along longitudinal axis A (shown in FIG. 2). More particularly, the valve sleeves 20 include a bottom sleeve 22 (also referred to as a downhole sleeve) mounted within a downhole portion of the housing 12, and a top sleeve 24 (also referred to as an uphole sleeve) mounted within an uphole portion of the housing 12. The valve sleeves 20 can be substantially aligned with one another and each include a bore therethrough such that fluid can flow freely along the valve assembly 10 (e.g., from one sleeve to the other through the housing 12). As will be described below, the valve sleeves 20 can be independently displaced with respect to one another within the passage 14 and can be arranged in various positions in order to direct fluid flow into predetermined fluid pathways of the valve assembly 10.

The valve sleeves 20 can be mounted within the housing 12 in a manner allowing the sleeves to slide, or shift, from one position to another. It should be understood that the expression "shift" can refer to the displacement of the valve sleeves 20 using a shifting tool, or a self-shifting mechanism provided as part of the valve assembly itself. While deploying a shifting tool can be a preferred way to shift the sleeves, in an alternative implementation the sleeves can be shifted or otherwise displaced remotely. The valve sleeves can be held in place within the valve housing 12 using any suitable method, structure or components, such as via an interference fit with the housing, via retaining rings (e.g., O-rings disposed about the valve sleeves), shear pins, a piston actuated mechanism or a combination thereof. As illustrated in FIGS. 3 to 5, this implementation includes shear pins 26 extending radially through the valve housing 12 and into at least one of the valve sleeves 20. The top sleeve 24 is held in place within the valve housing 12 via an interference fit, for example, the housing 12 can include one or more protruding edges 23 (seen in FIG. 6) extending circumferentially around the housing and into the fluid passage 16 to engage the top sleeve 24 when in position. As will also be described further below, some valve assembly implementations have a single valve sleeve, and the one or more valves sleeves can be axially slidable or fixed in place.

As will described further below, at least one of the valve sleeves 20 can be provided with a flow restriction component 27 positioned between the injection ports 18 and the fluid passage 14 and adapted to restrict the flow from the passage 14 through the ports 18 and into the reservoir. It should thus be understood that the valve assembly 10 can further be operated in a choked configuration, where the flow of fluid through the injection ports 18 is restricted, for example, via the use of the flow restriction component 27. Thus, the flowrate of fluids through the injection ports 18 when in the open configuration is greater than the flowrate of fluids through the injection ports 18 when in the choked configuration.

With reference to FIG. 3, the valve assembly 10 is shown in the closed configuration. In this position, the bottom sleeve 22 is mounted in the downhole region of the housing 12 in an occluding, or closed position, where the bottom sleeve 22 occludes the injection ports 18. Moreover, the top sleeve 24 can be mounted in the uphole region of the housing 12 in a first position, or "run-in-hole position". It is appreciated that, when the bottom sleeve 22 is in the closed position, the top sleeve 24 remains in the first position. In some implementations, the top and bottom sleeves 22, 24 can be shaped and configured to sealingly engage one another within the housing 12, such as in the configurations shown in FIGS. 3 and 5. In other words, the downhole end of the top sleeve 24 can contact the uphole end of the bottom sleeve 22 and create a fluid seal therebetween.

With reference to FIG. 4, the valve assembly 10 is shown in the open configuration. In order to operate the valve assembly 10 in the open configuration, the bottom sleeve 22 can be shifted from the occluding position to a non-occluding position, or open position, in order to open the injection ports 18. In some implementations, the bottom sleeve 22 is displaced in the downhole direction until the injection ports 18 are open, thus allowing fluid to be injected into the reservoir. However, it is appreciated that other configurations and/or positions of the valve sleeves are possible for opening the injection ports 18. Furthermore, it is noted that the top sleeve 24 can remain generally static when operating the valve assembly 10 from the closed configuration to the open configuration. The open configuration can be a fully open position where there is little to no resistance to flow from the passage 14 through the injection ports 18, as illustrated.

With reference to FIG. 5, the valve assembly 10 is shown in the choked configuration. In order to operate the valve assembly 10 in the choked configuration, the top sleeve 24 can be shifted from the first position (e.g., proximate an uphole end of the valve housing 12) to a second position where the top sleeve 24 overlays the injection ports 18 such that the flow restriction component 27 fluidly joins the injection ports 18 with the passage 14. More particularly, the top sleeve 24 is provided with the flow restriction component 27, and is shifted to the second position to arrange the flow restriction component 27 opposite the injection ports 18, thereby allowing fluids to flow from the fluid passage 14 through a flow restriction channel 30 or other flow restriction structure and into the reservoir via the ports 18 at a restricted flowrate. In this illustrated implementation, the flow restriction component 27 is provided at a downhole end of the top sleeve 24, although it is appreciated that other configurations are possible.

Figure 6:
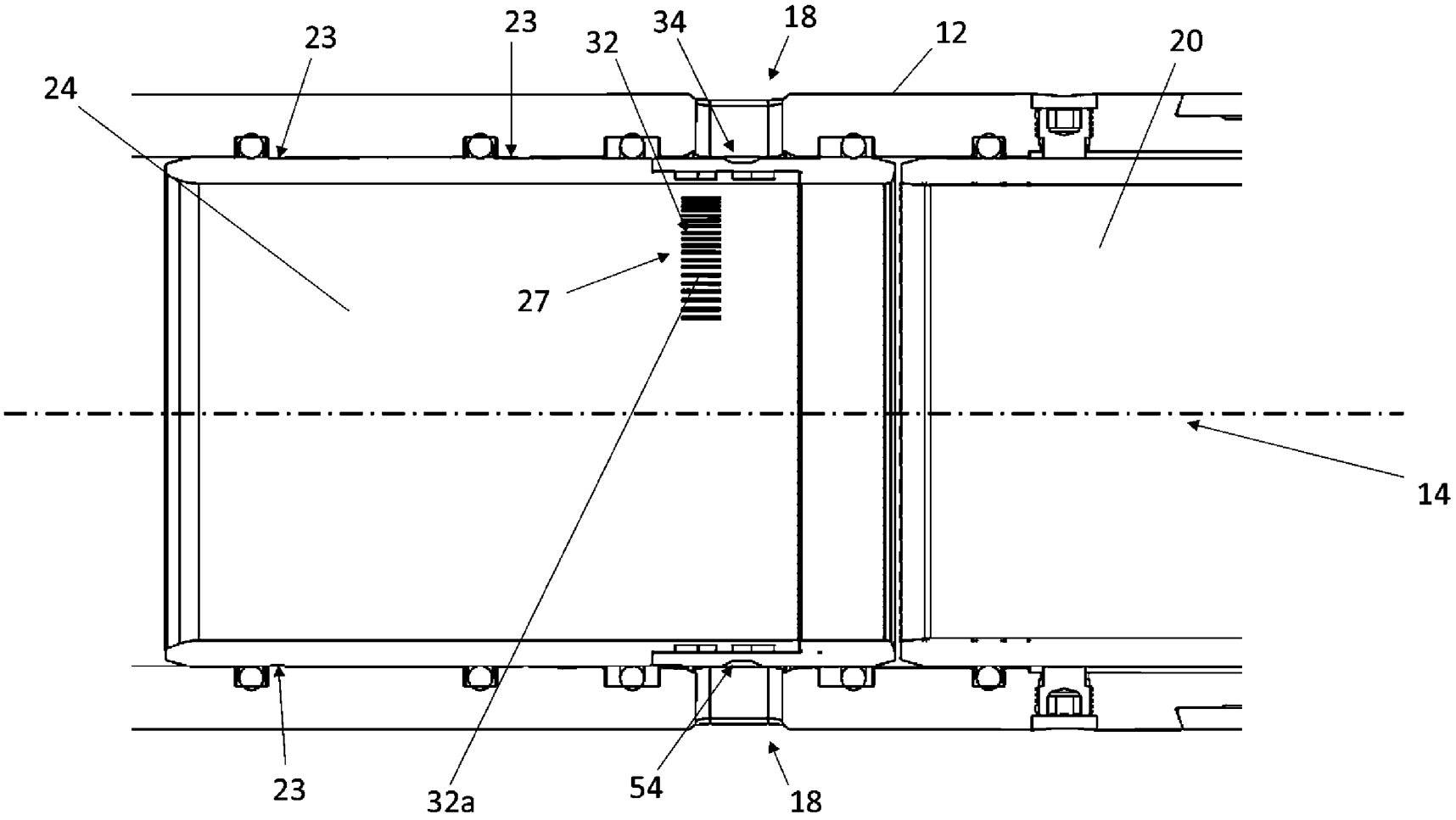
FIG. 6 is an enlarged view of a portion of the valve assembly shown in FIG. 5, showing a top sleeve having a portion thereof aligned with injection ports, according to an implementation.
Figure 7:
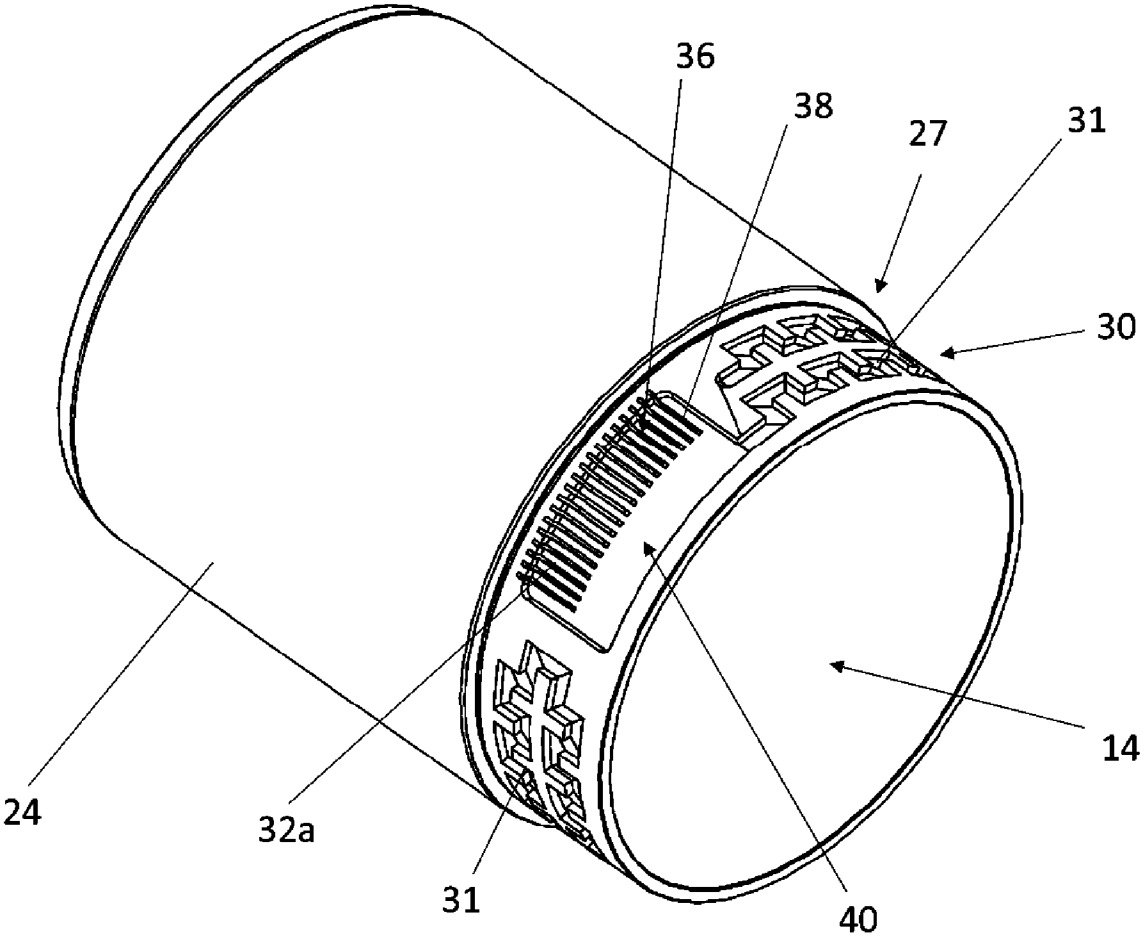
FIG. 7 is a perspective view of the top sleeve of the valve assembly according to an implementation, showing a fluid channel defined at a downhole end thereof.

As previously mentioned, the flow restriction component 27 can be configured to restrict the flowrate of fluid from the passage 14 through the ports 18, and thus into the reservoir. The flow restriction component 27 can take various forms. For example, the top sleeve 24 can be provided with a restricted passage configured to control the flowrate of injection fluid being injected into the surrounding reservoir. With reference to FIGS. 6 and 7, in this implementation the top sleeve 24 is provided with a fluid channel 30 shaped and adapted to allow fluid flow therethrough, and to fluidly connect the fluid passage 14 with the injection port 18. The fluid channel 30 can be shaped and configured to provide a resistance to fluid flow, therefore providing additional control on the flowrate of fluid being injected into the surrounding reservoir. The fluid channel 30 can take the form of a tortuous path that winds (e.g., boustrophedonically) across a portion of the top sleeve 24, such as around the downhole end thereof. However, it is appreciated that the tortuous path can have various other configurations.

Figure 8:
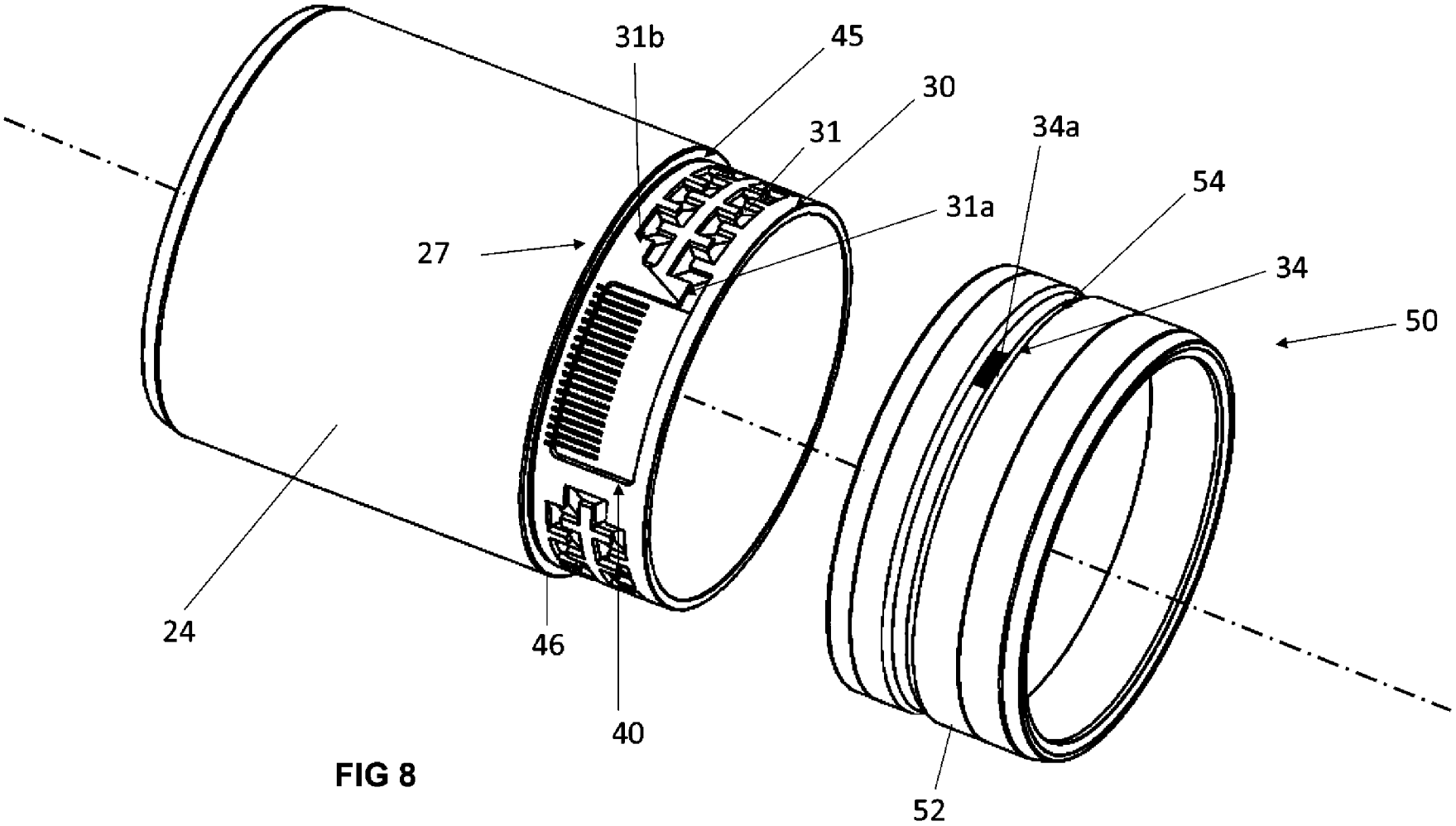
FIG. 8 is a perspective view of the top sleeve and a flow adjuster adapted to be mounted to and cooperate with the top sleeve, according to an implementation.

The fluid channel 30 can be defined between an outer surface of the top sleeve 24 and an inner surface of a separate component, such as the valve housing 12. In this implementation, and as will described further below, the valve assembly 10 can include a flow adjuster cap 50 (as shown in FIG. 8) configured to be coupled to the top sleeve 24 for defining a geometrical feature (e.g., the length) of the fluid channel 30. The fluid channel 30 can include a groove 31 defined in a thickness of the top sleeve 24 along the outer surface thereof (as seen in FIGS. 7 and 8), with the inner surface of the separate component (e.g., the valve housing or the flow adjuster cap) overlaying and enclosing the groove 31, thereby defining the closed fluid channel 30 adapted to allow fluid flow therethrough. In the present implementation, the fluid channel 30 includes a channel inlet section 32 defined in the inner surface of the top sleeve 24, and a channel outlet section 34 that can be defined in the outer surface of the top sleeve 24, with the groove 31 extending therebetween. When the valve assembly 10 is in the choked configuration, the channel outlet section 34 is preferably disposed opposite and in fluid communication with the injection ports 18 to enable fluid flow from the fluid passage 14, through the fluid channel 30 (e.g., along the groove 31), and then out through the injection ports 18.

Figure 10:
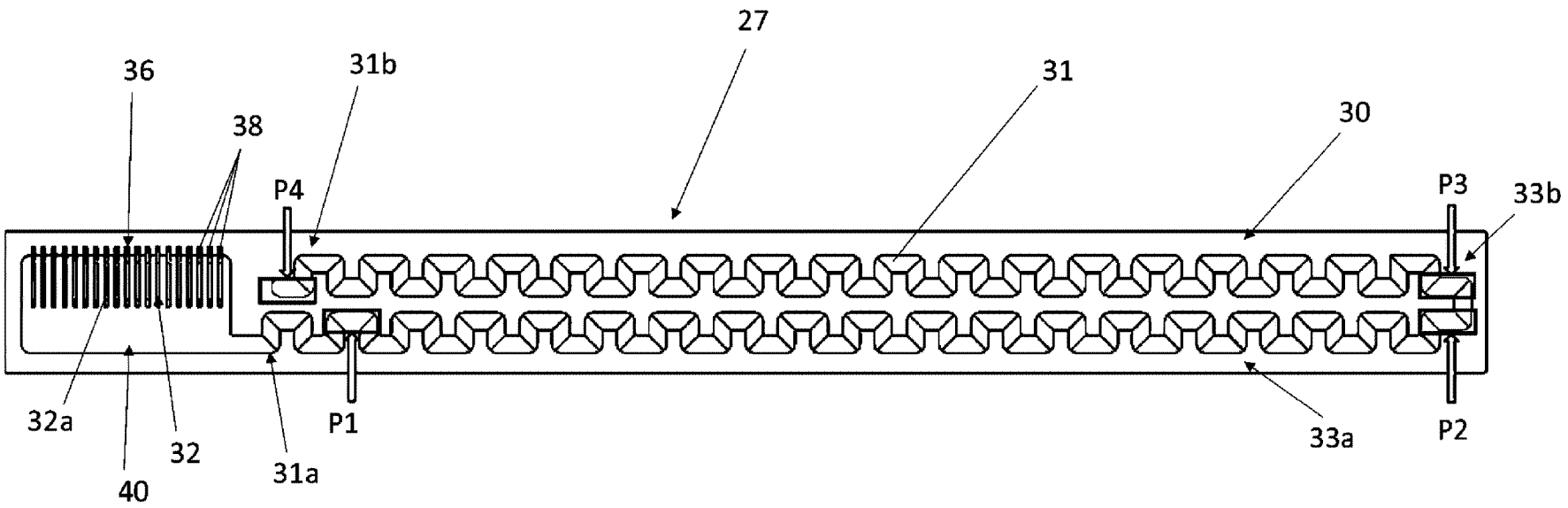
FIG. 10 is a flat view of a fluid channel according to an implementation, showing a tortuous configuration comprising a plurality of bends.

Referring to FIGS. 7 and 10, the channel inlet section 32 can include an inlet opening 32*a* for allowing fluid therethrough and into the groove 31, and a filtering component 36 adapted to prevent, or at least partially prevent, an intake of oversized and/or solid material from entering the fluid channel 30. The filtering component 36 can be adapted to reduce the risk of the fluid channel 30 (e.g., the groove 31) from becoming plugged or blocked by undesired material, such as cement slurry, entering the channel. It should be noted that the channel 30 can be filled with grease, or any suitable substance, prior to being run downhole to further prevent cement from entering the channel 30 while various components of the wellbore are being cemented. As seen in FIGS. 7 and 10, the filtering component 36 can include a plurality of slots 38 defined through the top sleeve 24 and allowing fluid flow therethrough. The slots 38 can be shaped, sized and configured to prevent material of a certain size or consistency from passing through the slot openings and entering the fluid channel 30. For example, the slots 38 can be configured to prevent particles having a size greater than 1/32" from entering the channel 30 and potentially blocking the flow path.

It should be noted that, in this implementation, the openings defined by each slot 38 define the inlet opening 32*a* of the fluid channel 30 to allow fluid to enter from the passage 14. It is appreciated that other configurations of the filtering component 36 are possible from mitigating the entry of oversized material into the fluid channel 30. For example, the fluid channel inlet section 32 can be provided with a screen positioned over an inlet orifice, among other possibilities.

Still referring to FIGS. 7 and 10, the groove 31 of the fluid channel 30 can take the form of a tortuous path having a plurality of generally 90-degree bends. It is appreciated that fluids flowing along the groove 31 can sustain a pressure drop due to the tortuous configuration of the groove 31. In addition, the groove 31 can extend circumferentially around the downhole end of the top sleeve 24. It is noted that the groove 31 can have a length extending around the top sleeve 24 any suitable number of times, such as once, twice (as illustrated in FIG. 7), thrice, and so on. For instance, if the groove 31 has a smaller width it may require a shorter length to enable similar flow restriction properties as a wider groove with a longer length. Furthermore, in this implementation, the groove 31 doubles back on itself such that an end portion of the groove 31*b* is positioned proximate to an inlet of the groove 31*a* (e.g., side-by-side with respect to each other). As such, the groove 31 can include a first groove portion 33*a* extending in a first direction, and a second groove portion 33*b* extending alongside the first groove portion in the opposite direction (e.g., the second groove portion is the portion of the groove 31 doubling back on itself). In addition, and as seen in FIG. 10, the first and second groove portions can be generally symmetrical to one another, although it is appreciated that other configurations are possible. It is also noted that additional groove portions could be provided such that each subsequent groove portion doubles back with respect to the previous groove portion.

Referring to FIGS. 7, 8 and 10, in some implementations the fluid channel 30 can include an inlet chamber 40 defined in the outer surface of the top sleeve 24. The inlet chamber 40 can be substantially flat and extend across a region of the outer surface of the top sleeve 24, and can be defined by an inset region. In this implementation, the inlet slots 38 can be sized arranged to open into the inlet chamber 40, thus allowing fluids to enter the inlet chamber 40 from the fluid passage 14. It is appreciated that the inlet chamber 40 is also in fluid communication with the groove 31 to enable fluid to flow into the groove 31 and toward the outlet section 34 and the injection ports. As seen in FIGS. 7 and 10, the inlet chamber 40 can have a notably greater width than the groove 31 such that the inlet chamber 40 can accumulate some foreign particles (e.g., cement slurry) therein without occluding the inlet of the fluid groove 31. In some implementations, the width of the inlet chamber 40 can be about 3 to 4 times greater than the height of the inlet chamber 40 (or depth of the inset region).

In some implementations, the flow area defined by the slots 38 can be between 10% and 20% greater than the cross-sectional area of the groove 31 such that the channel 30 is adapted to tolerate some clogging of the filtering component 36 (e.g., clogging of one or more slots 38 without impeding the flowrate of fluid going into and along the groove 31. In some implementations, about 50% of the slots 38 can become occluded without affecting the performance of the channel (e.g., flowrates, pressure drops, etc.).

In addition, it is noted that the inlet slots 38 can be shaped and sized to extend across a portion of the inlet chamber 40, such as across a first half of the inlet chamber 40, and that the groove inlet 31*a* is fluidly connected to a second half of the inlet chamber. This configuration of the inlet chamber 40 can further mitigate the intake of oversized or otherwise undesired material into the groove 31 of the fluid channel 30. For example, if slurry material (e.g., cement slurry) flows through the slots 38, the size of the inlet chamber 40 can be adapted to allow the cement slurry to settle in part of the chamber 40 (e.g., in an area opposite the groove inlet 31*a*) without blocking flow into the groove 31. It is noted that the inlet slots 38 can take up half, plus or minus up to 20%, of the area of the inlet chamber 40, for example. It is also noted that the relative dimensions and orientations of the components and features as illustrated in the figures should be taken as being disclosed herein, and that such dimensions and orientations could also be modified plus or minus up to 10% or 20% where appropriate.

Figure 9:
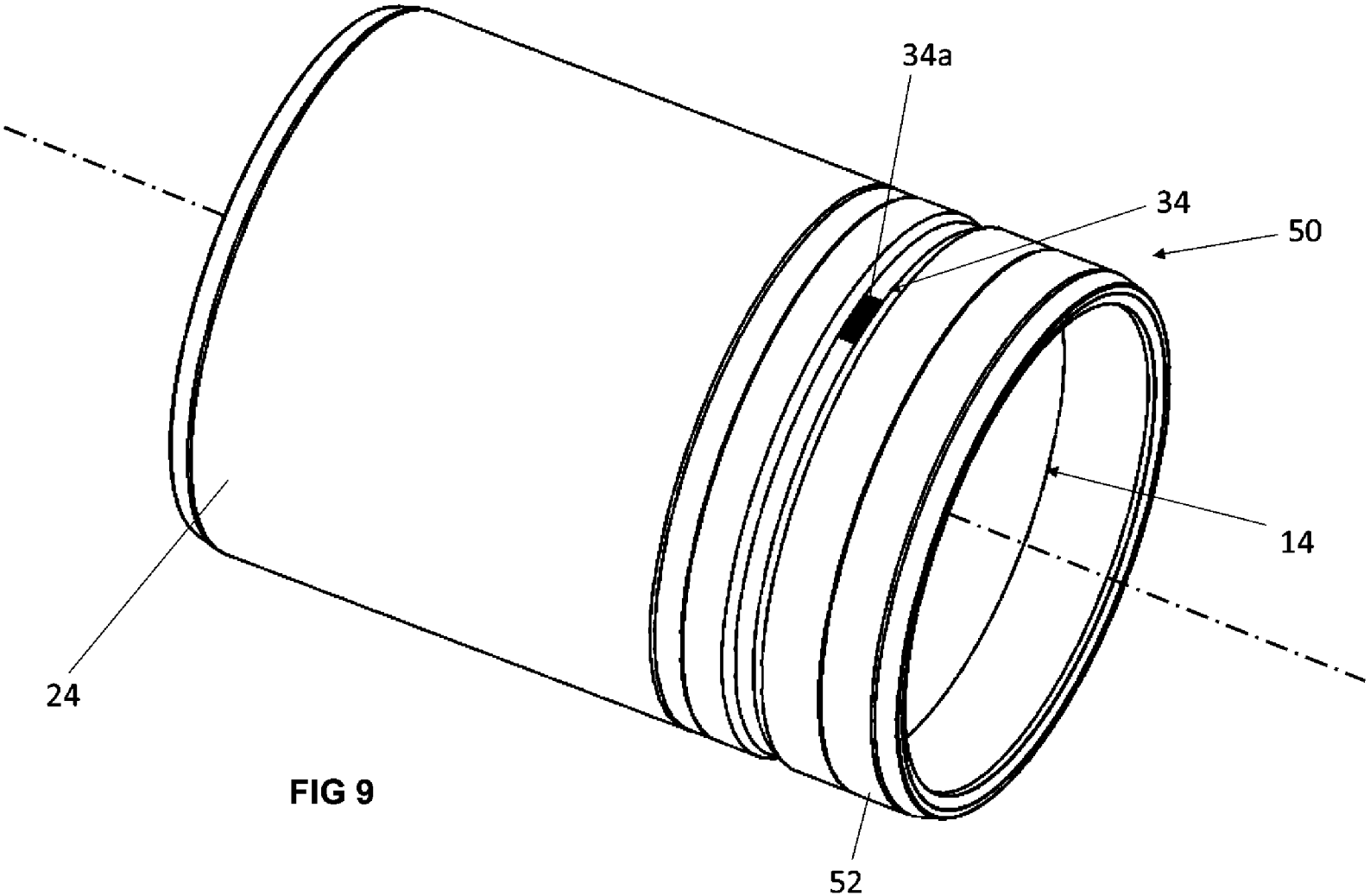
FIG. 9 is a perspective view of the top sleeve and flow adjuster shown in FIG. 8, showing the flow adjuster connected to the top sleeve for covering the fluid channel, according to an implementation.

Now referring to FIGS. 8 and 9, in addition to FIG. 6, the valve assembly 10 can be provided with a flow adjuster 50 configured to be coupled to the valve sleeve provided with the restriction component (e.g., the top sleeve 24). The flow adjuster 50 is configured to further control the flowrate of fluids from the central passage 14 into the reservoir. For example, the flow adjuster 50 can be configured to vary the length of the channel 30. The flow adjuster can be configured to move with respect to the channel 30 to define a length between inlet and outlet locations of the channel, thereby changing the flow resistance through the channel 30. In the illustrated implementation, the flow adjuster 50 includes a sleeve cap 52 provided with at least one opening that defines the channel outlet section 34 for establishing fluid communication between the groove 31 and the injection ports 18. As will be further described below, the sleeve cap 52 can be selectively positioned and coupled to the top sleeve 24 in a manner to arrange the opening in a desired position over the groove 31 to define the outlet section 34 at a certain position to set the length of the channel 30 and enable injection of fluid through the ports 18.

In some implementations, the sleeve cap 52 is substantially tubular or ring-shaped such that the sleeve cap 52 can be adapted to slide longitudinally within the valve housing 12, in a similar fashion to the valve sleeves. In this implementation, the top sleeve 24 and sleeve cap 52 can be adapted to move along the valve housing 12 as a single unit, although it is appreciated that other configurations are possible. Furthermore, the sleeve cap 52 can be coupled to the top sleeve 24 via any suitable method, such as via press-fit, fasteners, threaded connection, or a combination thereof.

In some implementations, the downhole end of the top sleeve 24 can have an outer diameter which is generally the same as or smaller than an inner diameter of the sleeve cap 52 to allow the sleeve cap 52 to slide onto the downhole end of the top sleeve 24. As seen in FIGS. 8 and 9, the sleeve cap 52 can be adapted to slide onto and overlay a portion of the top sleeve 24 in order to cover the inlet chamber 40 and the groove 31 of the fluid channel 30. Furthermore, the downhole end of the top sleeve 24 can have a smaller outer diameter than a central portion and/or an uphole end of the top sleeve 24. The downhole end of the top sleeve 24 can have an inset main surface in which the groove 31 and inlet chamber 40 are provided. In some implementations, the channel 30 is defined due to the connection of the sleeve cap 52 onto the downhole end of the top sleeve 24. The sleeve cap 52 can be press-fitted onto the top sleeve, thereby sealing the groove 31 in a manner such that fluids can only flow along the groove 31.

As seen in FIG. 8, the top sleeve 24 has a downhole lip 45 where the outer diameter of the top sleeve 24 changes. It should be noted that the downhole lip 45 can include an abutment surface 46 against which the sleeve cap 52 can abut when coupling the cap 52 to the sleeve 24. In addition, the outer diameter of the sleeve cap 52 can be substantially the same as the outer diameter of the central segment and/or uphole end of the top sleeve 24, which are uphole of the lip 45. Therefore, it is appreciated that the top sleeve 24 and sleeve cap 52 can have substantially the same outer diameter when connected to one another, which can facilitate movement thereof within the valve housing 12.

In this implementation, the outlet section 34 includes an outlet opening 34*a* extending through the sleeve cap 52 such that coupling the sleeve cap 52 to the top sleeve 24 positions the outlet opening 34*a* over a section of the groove 31 and establishes fluid communication between the groove 31 and the injection ports 18. The outlet opening 34*a* can have a size that is generally the same as or smaller than a diameter of the injection port 18, or a diameter/width of the groove 31. The sleeve cap 52 can be coupled to the top sleeve 24 in various positions to arrange the outlet opening 34*a* at corresponding positions along the groove 31. It should be understood that positioning the outlet opening 34*a* closer to the groove inlet 31*a* can define a shorter fluid channel 30 compared to positioning the outlet opening 34*a* further along the groove 31 (e.g., proximate the end portion 31*b*). In other words, the distance between the inlet opening 32*a* and the outlet opening 34*a* via the groove 31 section defined therebetween can be adjusted to a desired length by coupling the sleeve cap 52 to the top sleeve 24 in a corresponding position. In the illustrated implementation, the position of the outlet opening 34*a* is defined by the rotation of the sleeve cap 52 relative to the top sleeve 24. It should be noted that adjusting the length of the fluid channel 30 also adjusts the pressure drop sustained by the fluids flowing through the channel 30. Moreover, adjusting the length of the channel, along with the pressure drop, can provide additional tailored control of the flowrate of fluids through the valve assembly 10 and into the reservoir. A single design of top sleeve 24 and sleeve cap 52 can be used to provide many different channel lengths and therefore many different levels of flow resistance without requiring custom designs.

Referring again to FIG. 8, the opening 34*a* of the sleeve cap 52 can be axially positioned relative to the uphole edge of the cap 52 such that when the cap 52 abuts on the lip 45 of the top sleeve 24 the opening 34*a* is axially positioned over a predetermined part of the groove 31 and can be positioned over different parts of the groove 31 by rotating the cap 52. For example, when the groove 31 has first and second groove portions 33*a*, 33*b* that are axially spaced apart from each other, the opening 34*a* can be positioned to overlay only one of the first or second groove portions. In addition, when the fluid channel 30 has certain patterns, e.g., a boustrophedonic pattern as illustrated, the opening 34*a* can be positioned so that it can align with certain parts of the fluid channel 30.

For the illustrated fluid channel 30 in FIG. 10, for example, a given opening 34*a* could be provided to align with peaks and not with valleys of the fluid channel 30. The opening 34*a* could alternatively be provided to align with only the valleys. It is also noted that the cap 52 could also be provided with two openings, such that each opening can align with a corresponding part of the fluid channel while the other is occluded. For example, the cap 52 could include two openings that are axially spaced apart from each other and radially offset so that when one opening aligns with a peak of the first groove region 33*a*, the second opening does not align with the second groove region 33*b* as it would be positioned in between two adjacent peaks or valleys. Likewise, when the second opening is aligned with part of the second groove region 33*b*, the first opening is not aligned with the first groove region and is therefore blocked. In this manner, a single cap 52 could have multiple openings that are positioned so that only one of the openings aligns with a corresponding part of the fluid channel.

In addition, a channel pattern with alternating peaks and valleys can not only facilitate flow restriction but can also facilitate a multi-opening cap from being used to define different channel lengths. As mentioned above, it is also possible to provide different caps 52 with their opening being in different positions, such that selecting the cap 52 with a particular opening location would enable alignment of the opening with the desired part of the channel 30 depending on the length of channel that is desired. It should be noted that the fluid flowrate restriction provided by the channel is mainly defined by the tortuous configuration of the groove, whereby each bend (e.g., each 90-degree bend) creates a pressure drop along the channel. Increasing the length of the channel can increase the friction pressure loss of the fluid, although it is less than the pressure drop created by the tortuous configuration. It is appreciated that, in some implementations, such as the one illustrated in FIG. 10, the bends of the groove are provided at regular intervals such that increasing the flow length of the channel (or groove) can simultaneously mean increasing in the number of bends along the channel, thereby increasing both the frictional pressure drop (due to the length of the channel) and the turbulence pressure drop (due to the number of bends).

Figure 15:
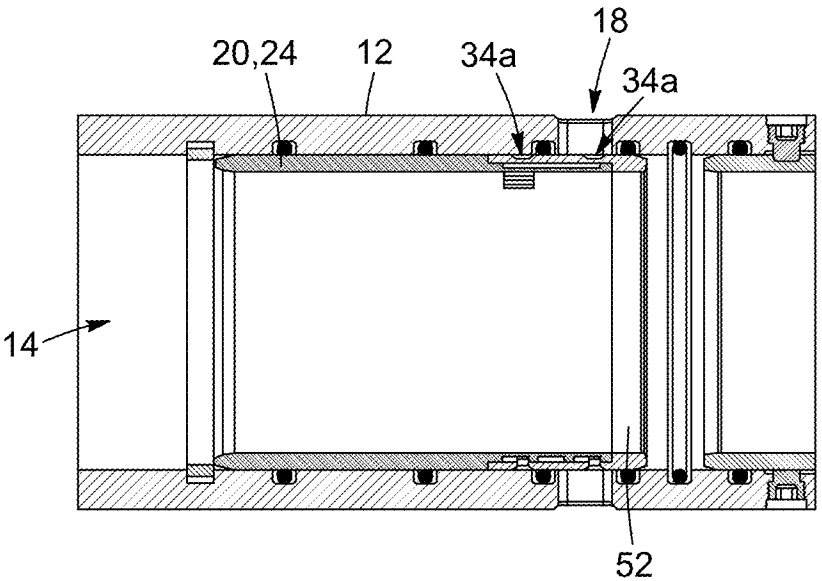
FIGS. 14 and 15 are transverse cut views of an alternate implementation of the valve assembly, showing a flow adjuster having at least two outlets adapted to be aligned with the injection ports of the housing.
Figure 14:
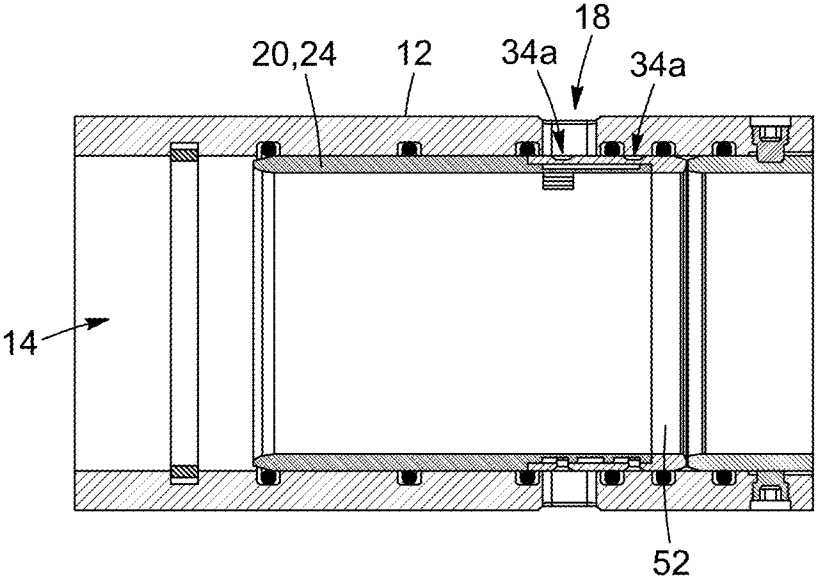

In other implementations, the groove 31 can have first and second groove portions 33*a*, 33*b* that include regions that are axially aligned with respect to one another. For example, the valleys of one of the groove portions can align with the peaks of the other one of the groove portions. Therefore, the sleeve cap 52 can be provided with a single opening adapted to align with the peaks of one groove portion, or with the valleys of the other groove portion by rotating the cap 52, and depending on the desired or required flow restriction. In another implementation, the sleeve cap 52 can be provided with a plurality of outlet openings at respective radial and/or axial positions, and the sleeve cap 52 is configured to be shifted to different positions (within the fluid passage or along the top sleeve) to align with different parts of the groove 31. In one implementation, and as illustrated in FIGS. 14 and 15, the sleeve cap 52 is provided with at least two outlet openings 34*a* configured to be aligned with the injection ports 18 of the valve. In this implementation, when a first outlet opening is aligned with the injection ports 18, a second outlet opening is occluded by the inner surface of the valve housing 12, and vice versa. Therefore, a single outlet opening enables fluid communication between the fluid passage 14 and the reservoir.

In some implementations, the channel outlet section 34 of the sleeve cap 52 can include an outlet groove 54 extending circumferentially about the outer surface of the sleeve cap 52 for allowing fluid to flow therealong. Therefore, fluids can flow from the groove 31, through the outlet opening 34*a* and along the outlet groove 54 so as to provide fluid flow to each injection port 18 provided about the valve housing 12. It should thus be understood that, in the choked configuration, the outlet groove 54 is adapted to be positioned opposite and in fluid communication with the injection ports 18 (shown in FIG. 6).

In this implementation, the outlet groove 54 can extend on either side of the outlet opening 34*a* and around an entire circumference of the sleeve cap 52 such that fluid can be injected into the reservoir via each one of the injection ports 18 distributed circumferentially around the housing. However, it is appreciated that other configurations are possible. For example, the outlet groove 54 can extend about a portion of the sleeve cap 52 such that fluid is routed to a desired number of injection ports 18 in certain positions. In addition, various other flow passages could be provided to enable fluid communication from the opening 34*a* to the ports 18, depending on the structure of the valve assembly and the components used. In some implementations, the diameter of each injection port 18 can be generally the same or have different diameters for defining different injection rates into the reservoir. Therefore, it should be understood that, in some implementations, the injection rate of fluids into the reservoir can be selectively adjusted by controlling the length of the fluid channel 30 (via the position in which the sleeve cap 52 is coupled to the top sleeve 24), by controlling the injection ports 18 with which the outlet groove is aligned, or a combination thereof.

The fluid channel 30 can be shaped and configured to enable operation of the valve assembly 10 in a similar fashion as a valve assembly 10 comprising straight orifices extending through the housing 12 (i.e., without the flow restriction component). For example, and with reference to FIG. 10, coupling the sleeve cap to the top sleeve and arranging the outlet opening relative to the groove 31 in a first position (P1) enables the valve assembly 10 to operate similar to a valve assembly with a single opening of significantly smaller diameter than the width of the channel, which would be more prone to plugging with debris.

For example, positioning the sleeve cap in the first position (P1) enables the valve assembly 10 to operate similar to a valve assembly with one or more straight orifices having a diameter between about 1.65 mm and about 2.05 mm. In a similar fashion, positioning the outlet opening in a second position (P2) can be generally equivalent to an orifice size between about 0.8 mm to about 1.2 mm, positioning the outlet opening in a third position (P3) can be generally equivalent to the second position, e.g., can be compared to straight orifices having a diameter between about 0.8 mm to about 1.2 mm, and positioning the outlet opening in a fourth position (P4) can be generally equivalent to an orifice size between about 0.65 mm and about 1.05 mm. As previously mentioned, it should be noted that increasing the flow length of the channel (or groove 31) can simultaneously mean increasing in the number of bends along the groove, thereby increasing both the frictional pressure drop (due to the length of the groove) and the turbulence pressure drop (due to the number of bends). In other words, each additional bend in the tortuous configuration of the groove can be configured to add an equivalent additive degree of flow restriction.

It is appreciated that the pressure differential between the passage of the valve assembly and the reservoir should be substantially the same to establish these equivalences. Moreover, it is understood that orifices of greater size allow for a greater flowrate of fluid therethrough when compared to smaller orifices. As such, positioning the outlet opening closer to the groove inlet 31*a* defines a shorter fluid channel 30, and thus fewer bends in the groove for the fluid to travel, which reduces the flow resistance and enables for greater flowrates of fluid into the surrounding reservoir.

Figure 11:
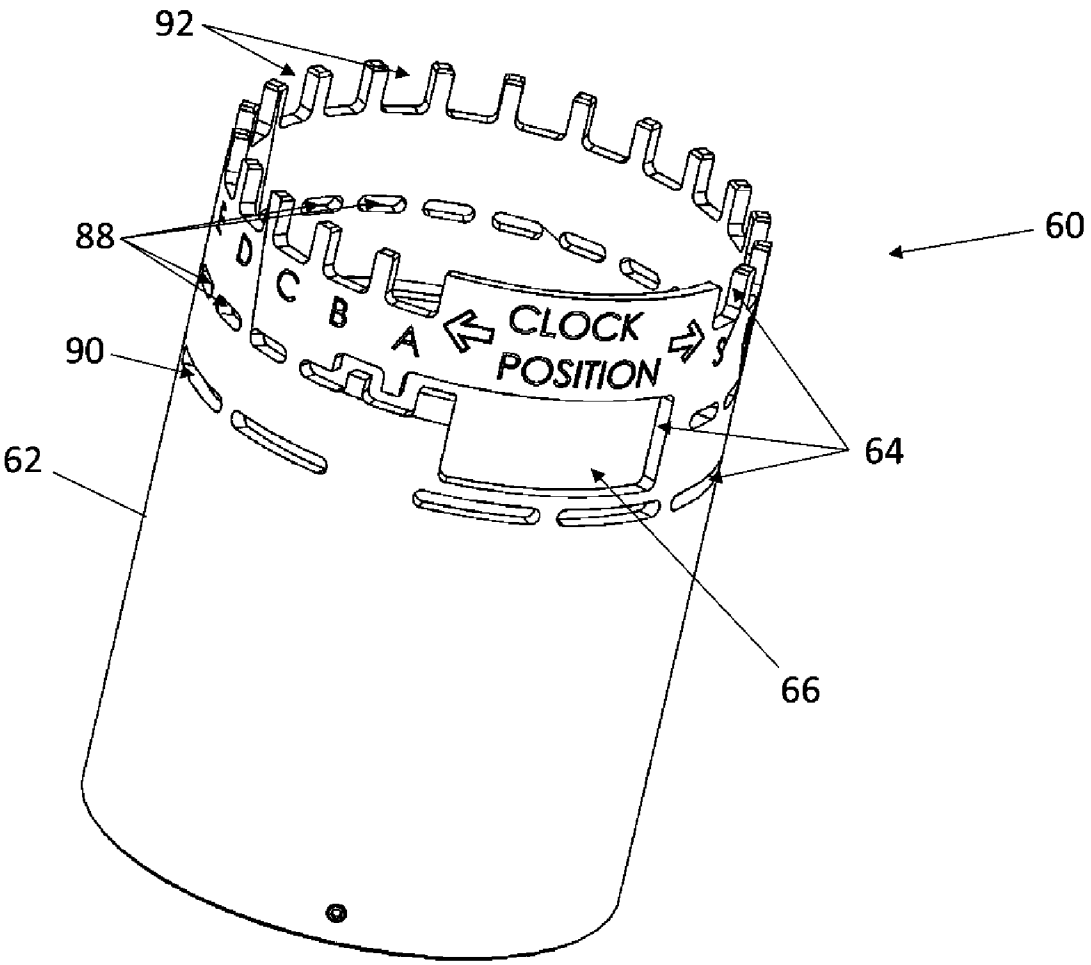
FIG. 11 is a front perspective view of an alignment device, according to an implementation.

Now referring to FIGS. 11 to 12D, an alignment device 60, along with a method of selectively coupling the sleeve cap 52 to the top sleeve 24 using the alignment device 60, will be described. Broadly described, the alignment device 60 is configured to facilitate positioning the sleeve cap 52 relative to the top sleeve 24 in various predetermined positions. Each predetermined position corresponds to a position of the outlet opening 34*a* relative to the groove 31, such as positions P1, P2, P3 and P4 shown in FIG. 10.

In this implementation, the alignment device 60 includes a tubular body 62 adapted to receive therein one of the valve sleeves (e.g., the top sleeve) and the sleeve cap 52. In some implementations, the tubular body 62 can be provided with markers 64 configured to indicate the position of the sleeve cap 52 relative to the top sleeve 24, and more precisely to indicate the position of the outlet opening 34*a* relative to the groove 31. The markers 64 can include various visual indicia configured to provide visual indication and confirmation of the position of the valve components relative to one another. In this implementation, the markers 64 include apertures through the tubular body 62 configured to enable visual indication of the component within the tubular body 62 (e.g., the top sleeve 24 and/or the sleeve cap 52).

For example, the markers 64 can include an inlet chamber marker 66 configured to provide an indication of the position of the top sleeve 24 within the tubular body 62. More specifically, the inlet chamber marker 66 includes an aperture shaped and sized to match the dimensions of the inlet chamber 40 of the fluid channel 30. Therefore, the inlet chamber 40 can be aligned with the inlet chamber marker 66, thereby providing visual confirmation of the desired position of the top sleeve 24 within the tubular body 62. Alternatively, or additionally, the markers 64 can include one or more groove section markers 88 provided around the tubular body 62 and configured to align with a corresponding section of the groove 31. In this implementation, the groove section markers 88 are aligned with the groove along the first groove portion 33*a*. However, it is appreciated that the groove section markers 88 can also be adapted to align with the second groove portion 33*b*. As seen in FIG. 11, the markers 64 can further include one or more lip markers 90 configured to align with the lip 45 of the top sleeve 24 defining the downhole end thereof.

When the top sleeve 24 is arranged (e.g., oriented) within the alignment device 60 in the desired position, i.e., when the markers 64 are aligned with the corresponding components of the top sleeve 24, the top sleeve 24 can be temporarily secured to the tubular body 62. As such, the top sleeve 24 remains substantially immobile with respect to the alignment device 60 while the sleeve cap 52 is coupled thereto. In this implementation, the top sleeve 24 is secured to the tubular body 62 via a plurality of fasteners 100 extending through the tubular body 62 and top sleeve 24. Other fastening methods are also possible.

The markers 64 of the alignment device 60 can further include a plurality of outlet markers 92 configured to indicate the orientation of the sleeve cap 52 for positioning the outlet opening 34*a* in the desired position when coupling the sleeve cap 52 to the top sleeve 24. In this implementation, the outlet markers 92 include apertures defined at a top end of the tubular body 62 (e.g., apertures A to S) shaped and configured to provide visual indication of the outlet opening 34*a* as the sleeve cap 52 is coupled to the top sleeve 24. The tubular body 62 can be adapted to retain the top sleeve 24 therein and receive a portion of the sleeve cap 52 proximate the top end. When the sleeve cap 52 is within the top end of the tubular body 62, the sleeve cap 52 can be rotated to the desired position prior to sliding the sleeve cap 52 onto the top sleeve 24. The sleeve cap 52 can therefore be "clocked" within the tubular body 62 such that the outlet opening 34*a* moves between the various clock positions (i.e., between the outlet markers 92) until the outlet opening 34*a* aligns with the desired marker. Once the outlet opening 34*a* is aligned with (e.g., positioned within) the desired outlet marker 92, the sleeve cap 52 can be pressed on, slid onto, or otherwise connected to the top sleeve 24, thereby coupling the components together in the desired radial orientation.

Figure 12B:
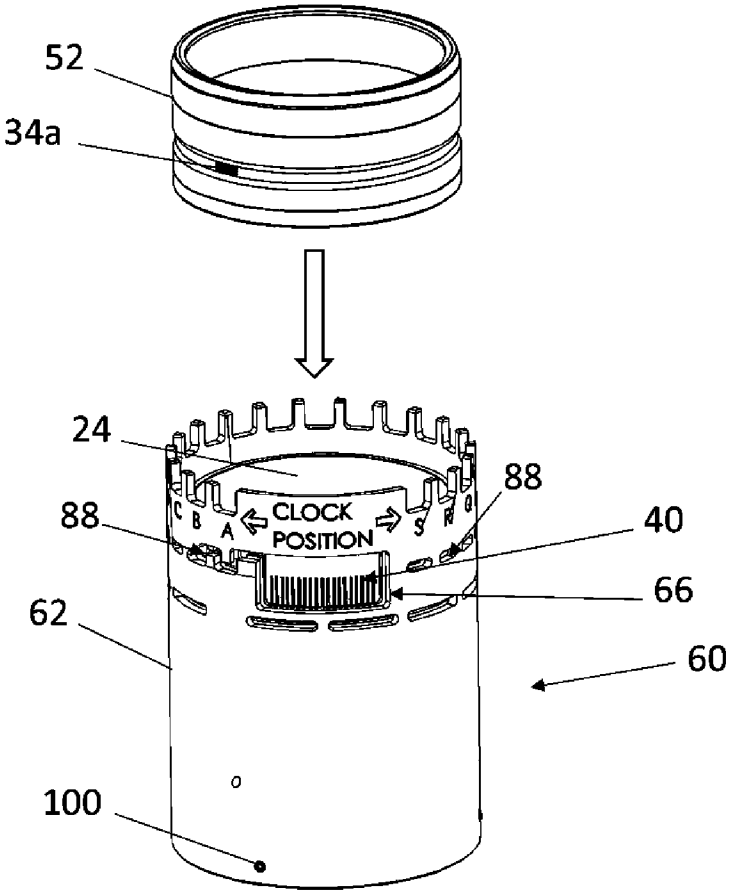
FIGS. 12A to 12D are front perspective views of the alignment device shown in FIG. 11 being used to align the flow adjuster with the top sleeve, according to possible implementations.
Figure 12A:
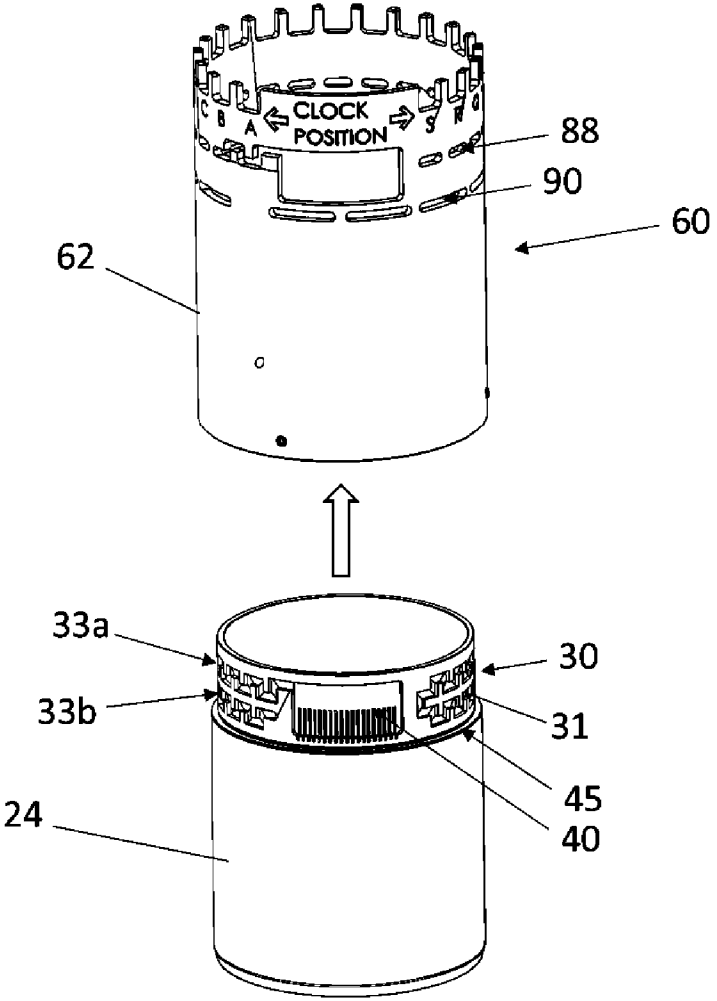
Figure 12D:
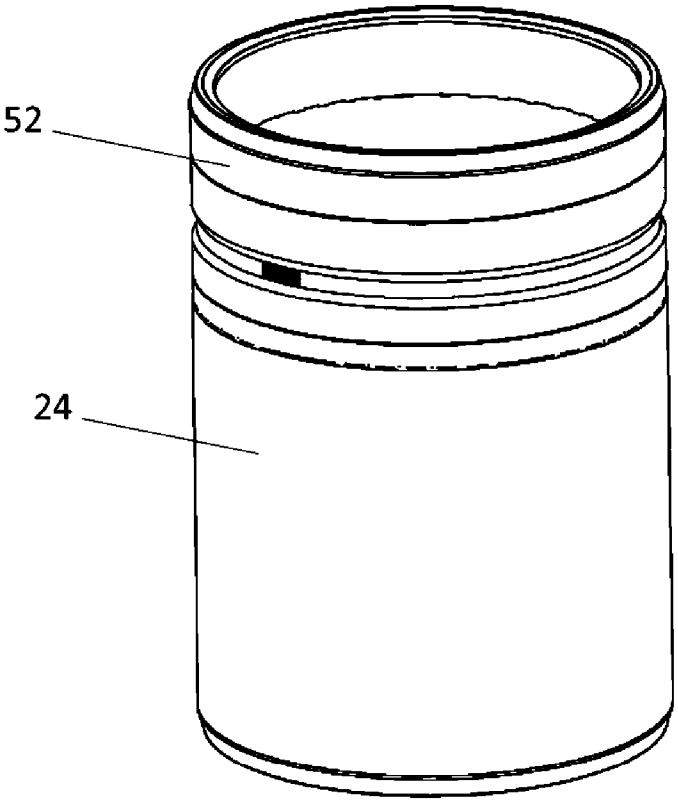
Figure 12C:
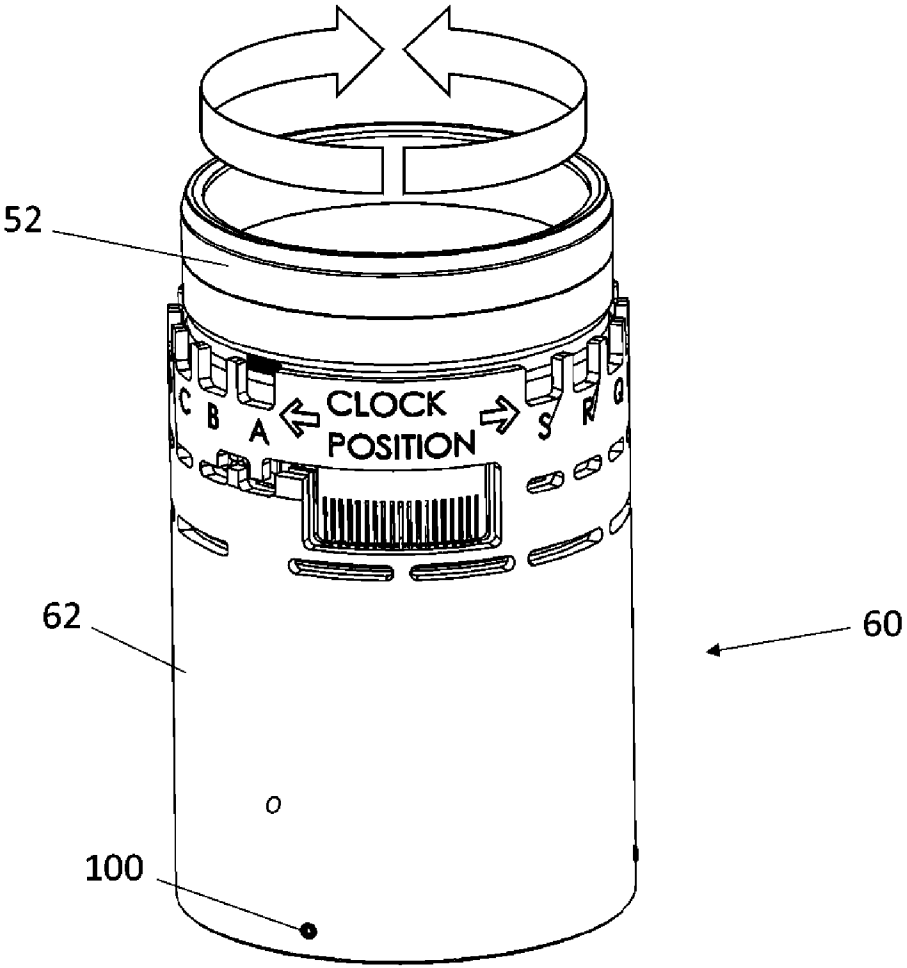

Referring more specifically to FIGS. 12A to 12D, the general method for coupling the sleeve cap 52 to the top sleeve 24 in the desired position is illustrated. The top sleeve 24 is initially inserted within the tubular body 62 of the alignment device 60 (FIG. 12A). The top sleeve 24 is then oriented within the tubular body 62 via the visual markers 64 and secured within the tubular body 62. The sleeve cap 52 is then positioned in the tubular body 62 proximate the top end thereof (FIG. 12B). The sleeve cap 52 can then be clocked into the desired position via a rotation thereof within the tubular body 62 (FIG. 12C). Finally, the sleeve cap 52 is coupled to the top sleeve 24 via any suitable method such that the outlet opening 34*a* is positioned over the desired section of the groove, and the top sleeve 24 is removed from the alignment device 60 (FIG. 12D). With the sleeve cap 52 coupled onto the top sleeve 24, the top sleeve 24 can be installed within a valve housing 12 along with the other components of the valve assembly 10. Once assembled, the valve assembly 10 can be installed along a wellbore string for deployment down a wellbore.

Figure 13:
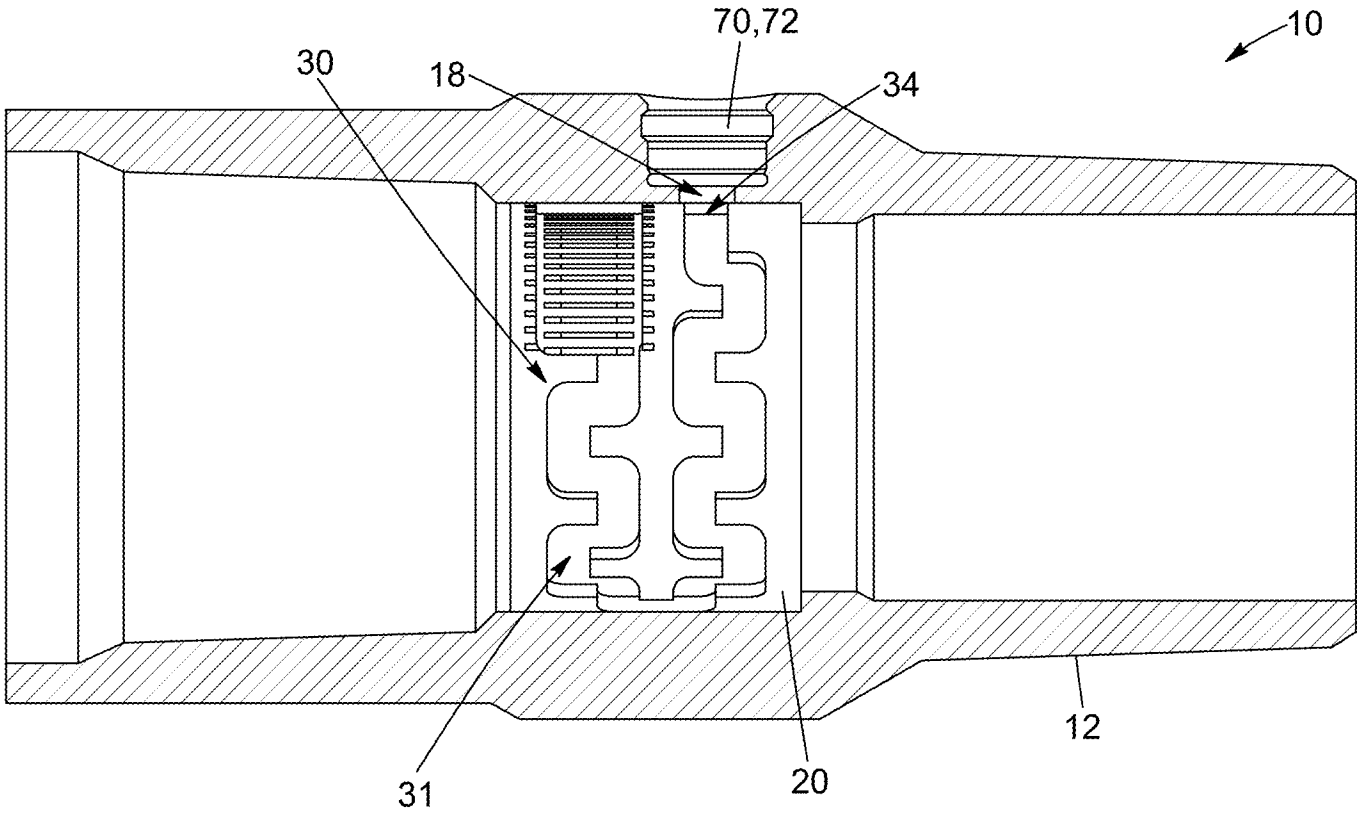
FIG. 13 is a transverse view of an alternate implementation of the valve assembly, showing a single valve sleeve mounted within the housing, and a single injection port, according to an implementation.

It should be noted that the valve assembly 10 can have various other forms adapted to cooperate with the flow adjuster. With reference to FIG. 13, a valve sleeve 20, which includes the fluid channel 30, can be fixed within the housing, with the fluid channel outlet 34 provided by aligning the injection port 18 with the desired location along the groove of the channel 30 to create the desired flow restriction. In this implementation, the injection port includes a fluid pressure activatable barrier 70, such as a burst disc 72, to prevent fluid flow into the reservoir prior to creating sufficient pressure within the wellbore to burst the barrier. The sleeve cap (not shown in FIG. 13) can thus be positioned, using the alignment device (seen in FIG. 11), to define a fluid channel having the desired length and to establish fluid communication between the fluid passage and the injection port. Fluid can then flow along the fluid channel and create sufficient pressure on the burst disc to break the disc and enable fluid injection into the reservoir at a restricted flow rate defined at least in part by the channel length.

As illustrated in FIG. 13, it is appreciated that the valve assembly 10 can include a single valve sleeve 20 secured within the housing via any suitable method, such as with the use of fasteners or via a press-fit connection. In some implementations, the valve assembly can be provided with a single injection port 18, whereby the desired portion of the groove 31 can be aligned with the injection port 18 to define the desired length between the channel inlet and the injection port 18. In such implementations, it should be noted that the sleeve cap can be optional, and the valve sleeve 20 can be clocked to the desired position within the valve housing 12 to align the channel with the injection port 18 in the desired configuration (e.g., to create a desired channel length, have a desired number of bends in the tortuous path, etc.). The inner surface of the valve housing 12 can be adapted to overlay and enclose the groove 31, thereby defining the closed fluid channel 30 adapted to allow fluid flow therethrough (i.e., from the inlet to the injection port 18). It should be noted that clocking the valve sleeve directly within the valve housing 12 to align the channel 30 with the injection port 18 can be implemented in previously described implementations, such as in implementations with a pair of valve sleeves, and where the valve sleeves slide within the valve housing.

It is appreciated that the valve sleeve, and more particularly the fluid channel, can have any suitable configuration and/or cross-sectional shape in order to reduce the flowrate of fluids flowing between the fluid passage and the surrounding reservoir. Moreover, the flow adjuster, e.g., the sleeve cap, can have any suitable configuration for cooperating with the valve sleeve and fluid channel to provide additional control of the flowrate of fluids being injected in the reservoir.

As previously mentioned, the valve assembly can be integrated as part of a wellbore string which is deployed in a wellbore to perform various operations. In some implementations, the wellbore string can be made up of conduits, packers and valve assemblies for the recovery of hydrocarbons, or other wellbore fluids. It is noted that recovering fluids from an underground formation can be enhanced by fracturing the formation in order to form fractures through which fluids can flow from the reservoir into the wellbore. Fracturing can be performed prior to primary recovery where fluids, such as hydrocarbons, are produced to the surface without imparting energy into the reservoir. Fracturing can be performed in stages along the well to provide a series of fractured zones in the reservoir. Following primary recovery, it can be of interest to inject fluids to increase reservoir pressure and/or displace hydrocarbons as part of a secondary recovery phase. Tertiary recovery can also be performed to increase the mobility of the hydrocarbons, for example by injecting mobilizing fluid, e.g., via the valve assembly described herein, and/or heating the reservoir. Tertiary recovery of oil is often referred to as enhanced oil recovery (EOR). Depending on various factors, primary recovery can be immediately followed by tertiary recovery without conducting any secondary recovery. In addition, some recovery operations include elements of pressurization and displacement as well as mobilizing of the hydrocarbons.

The valve assembly can be installed within the well for any other operation, such as injecting fluid as part of a waterflooding or gas flooding process, or via a cyclic process, such as "huff and puff". In some implementation, the valve assembly can be adapted for the production of fluids, such that fluids can be recovered from the reservoir at a controlled flowrate. Therefore, it is appreciated that the valve assembly can be adapted for at least one of injection and production operations. Other applications are also possible using the valve assembly described herein, such as geothermal applications, solution mining operations, frac-to-frac operations (synchronous and/or asynchronous), or any other applications in which improved control of fluids flowrates are desired or required.

In some implementations, the injection fluid can be a liquid, such as water, or a gas, such as vapour phase $CO_2$, or a combination thereof depending on the process being implemented. The injection fluid can be miscible or immiscible with the oil in the reservoir. The injection fluid could be field gas or enriched field gas, methane, methane blends, nitrogen, air, ethane, light gaseous hydrocarbons, or other gases or mixtures of such gases that may be suitable for secondary or tertiary recovery. The selection of the fluid can be based on various reservoir properties. It is noted that the injection fluid can depend on the EOR method being used, and that the valves can be designed and implemented depending on the type of injection fluid to be used and/or depending on various criterions, such as injection flowrates and pressures, for example.

Although the present disclosure generally relates to and illustrates implementations of a valve assembly comprising a pair of valve sleeves and being adapted for the injection of fluid into a surrounding reservoir, it is appreciated that the present disclosure may be embodied in other specific forms. For example, the fluid channel can be defined along the inner surface of the valve sleeve, and connecting the sleeve cap to the valve sleeve includes having a portion of the sleeve cap extend into the valve sleeve to cover the fluid channel and align the openings to one another to enable injection into the reservoir at a controlled flowrate. The described example implementations are to be considered in all respects as being only illustrative and not restrictive. The present disclosure intends to cover and embrace all suitable changes in technology. The scope of the present disclosure is, therefore, described by the appended claims rather than by the foregoing description. The scope of the claims should not be limited by the implementations set forth in the examples, but should be given the broadest interpretation consistent with the description as a whole.

In another example implementation, the valve sleeve can be arranged outside of the valve housing while still being in fluid communication with the port, and the sleeve cap could then be arranged to cooperate with the valve sleeve arranged in this way. In another example, the valve assembly could be configured so that the opening of the flow adjuster aligns with and defines a channel inlet section of the fluid channel instead of defining a channel outlet section. In yet another example, the groove of the fluid channel can be defined in a thickness of the inner surface of the valve housing, with the valve sleeve (or another component) being arranged so as to overlay and cover the groove from within the valve housing. It is also possible to provide a valve housing having injection ports 18 of different sizes, either for the same valve assembly, or for different valve assemblies installed along the wellbore. The channel can have any other suitable shape, size and configuration which would allow for a pressure differential and/or a fluid flowrate restriction. For example, the channel can be a Tesla fluid valve extending between the passage of the valve assembly and the surrounding reservoir.

As used herein, the terms "coupled", "coupling", "attached", "connected" or variants thereof as used herein can have several different meanings depending in the context in which these terms are used. For example, the terms coupled, coupling, connected or attached can have a mechanical connotation. For example, as used herein, the terms coupled, coupling, connected or attached can indicate that two elements or devices are directly connected to one another or connected to one another through one or more intermediate elements or devices via a mechanical element depending on the particular context.

It is also noted that, for disclosure purposes, the figures can be viewed as disclosing relative sizes and proportions of the components illustrated therein. Of course, these sizes and proportions should not be viewed as limiting, as various other relative sizes, shapes, proportions and other features can be used within the context of the present technology.

It should be noted that, in the above description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The implementations, geometrical configurations, materials mentioned and/or dimensions shown in the figures are optional, and are given for exemplification purposes only.

In addition, although the optional configurations as illustrated in the accompanying drawings comprises various components and although the optional configurations of the valve assembly as shown may consist of certain geometrical configurations as explained and illustrated herein, not all of these components and geometries are essential and thus should not be taken in their restrictive sense, i.e., should not be taken as to limit the scope of the present disclosure. It is to be understood that other suitable components and cooperations thereinbetween, as well as other suitable geometrical configurations may be used for the implementation and use of the valve assembly, and corresponding parts, as briefly explained and as can be easily inferred herefrom, without departing from the scope of the disclosure.

The invention claimed is:

1. A valve assembly for integration within a wellbore string disposed within a subterranean reservoir, the wellbore string defining a wellbore string passage therethrough and includes injection ports for establishing fluid communication between the wellbore string passage and the subterranean reservoir, the valve assembly comprising:

a valve sleeve operatively mounted within the wellbore string and comprising a fluid channel having an inlet opening adapted to communicate with the wellbore string passage and being positionable over at least one injection port to establish fluid communication between the wellbore string passage and the at least one injection port, the fluid channel being shaped and configured to create a fluid flowrate restriction between the wellbore string passage and the at least one injection port; and a flow adjuster comprising an opening and being connectable to the valve sleeve to align the opening with a portion of the fluid channel, the opening defining an outlet of the fluid channel such that a flow length of the fluid channel is defined between the inlet opening and the outlet, wherein connecting the flow adjuster to the valve sleeve allows fluid to flow from the fluid channel through the opening to the injection port, wherein the flow adjuster is selectively adjustable relative to the valve sleeve to align the opening with different portions of the fluid channel in order to adjust the flow length of the fluid channel, where a level of the fluid flowrate restriction created by the fluid channel is a function of the flow length of the fluid channel.

2. The valve assembly of claim 1, wherein the fluid channel comprises a groove defined in an outer surface of the valve sleeve, the groove being shaped and configured to create the flowrate restriction.

3. The valve assembly of claim 2, wherein the groove is boustrophedonically shaped and extends circumferentially around at least part of the valve sleeve.

4. The valve assembly of claim 2, wherein the groove extends circumferentially around at least part of the valve sleeve in a slaloming pattern.

5. The valve assembly of claim 2, wherein the inlet opening is defined in an inner surface of the valve sleeve, the inlet opening being in fluid communication with the groove, and wherein the outlet is adapted to establish fluid communication between the groove and the at least one of the injection ports.

6. The valve assembly of claim 5, wherein the fluid channel includes an inlet chamber defined in the outer surface of the valve sleeve, the inlet chamber being in fluid communication with the groove and being sized and configured to mitigate intake of undesired material into the groove.

7. The valve assembly of claim 5, wherein the flow adjuster comprises a sleeve cap adapted to be coupled to the valve sleeve and cover the groove of the fluid channel but for the opening communicating therewith.

8. The valve assembly of claim 7, wherein the outlet is defined through a thickness of the sleeve cap, and wherein the fluid channel establishes fluid communication between the wellbore string passage and the at least one injection port, via the outlet, upon coupling the sleeve cap to the valve sleeve and aligning the opening with the portion of the fluid channel.

9. The valve assembly of claim 8, wherein the sleeve cap comprises an outlet groove extending on either side of the outlet to enable fluid flow therealong, and wherein the outlet groove is adapted to be positioned opposite the injection ports to provide fluid communication therewith.

10. The valve assembly of claim 7, wherein the sleeve cap is adapted to be coupled to the valve sleeve in a plurality of predetermined positions to define respective flow lengths of the fluid channel to adjust the extent of the fluid flowrate restrictions.

11. The valve assembly of claim 10, wherein each one of the predetermined positions corresponds to a radial position of the sleeve cap relative to the valve sleeve, and wherein the sleeve cap is rotatable about the valve sleeve between the predetermined positions.

12. The valve assembly of claim 1, wherein the fluid channel corresponds to a Tesla fluid valve.

13. The valve assembly of claim 1, wherein the valve sleeve is fixed relative to the wellbore string.

14. The valve assembly of claim 1, further comprising a valve housing coupled to the wellbore string, and wherein the valve sleeve is operatively mounted within the valve housing.

15. A valve assembly for integration within a wellbore string disposed within a subterranean reservoir and defining a fluid passage and having a fluid port, the valve assembly comprising:

a flow restriction component comprising a single fluid channel having a first end provided with a first opening in fluid communication with the fluid passage and a second end, the single fluid channel being configured to create a fluid flowrate restriction such that fluid flowrate between the fluid passage and the fluid port is restricted;

a flow adjuster having an opening and being configured to cooperate with the single fluid channel such that positioning the opening relative to the single fluid channel defines a second opening of the single fluid channel adapted to be in fluid communication with the fluid port, the first opening and the second opening defining a flow length of the single fluid channel therebetween, wherein the opening is positionable relative to the single fluid channel in a plurality of positions for adjusting the flow length to different flow lengths, and wherein a level of the fluid flowrate restriction created by the single fluid channel is a function of the flow length of the single fluid channel.

16. The valve assembly of claim 15, wherein the different flow lengths are defined by rotation of the flow adjuster about a longitudinal axis of the valve assembly.

17. The valve assembly of claim 16, wherein the flow restriction component is configured such that, upon rotation of the flow adjuster, the opening is alignable with one of a plurality of fluid communication regions of the single fluid channel or one of a plurality of blockage regions of the single fluid channel.

18. The valve assembly of claim 15, wherein the single fluid channel is boustrophedonically shaped to create the fluid flowrate restriction.

19. The valve assembly of claim 15, wherein the single fluid channel extends in a slalom pattern to create the fluid flowrate restriction.

20. The valve assembly of claim 15, wherein the single fluid channel corresponds to a Tesla fluid valve to create the fluid flowrate restriction.

21. A valve assembly for integration within a wellbore string disposed within a subterranean reservoir and defining a fluid passage therethrough and having a fluid port, the valve assembly comprising:

a valve sleeve operatively mounted within the wellbore string and comprising a single fluid channel having a channel inlet and being adapted to establish fluid communication between the fluid passage and the fluid port, the valve sleeve being selectively positionable within the fluid passage to adjust a flow length defined between the channel inlet and the fluid port, the single fluid channel being shaped and configured to create a fluid flowrate restriction along the flow length, wherein a level of the fluid flowrate restriction created by the single fluid channel is a function of the flow length.

22. The valve assembly of claim 21, wherein the valve sleeve is positionable within the fluid passage to align different portions of the single fluid channel with the fluid port to adjust the flow length.

23. The valve assembly of claim 21, wherein the single fluid channel corresponds to a Tesla fluid valve to create the fluid flowrate restriction.

24. The valve assembly of claim 21, wherein the single fluid channel comprises a groove defined in an outer surface of the valve sleeve, and wherein a portion of the groove is adapted to be aligned with the fluid port.

25. The valve assembly of claim 24, wherein the groove is boustrophedonically shaped to create the fluid flowrate restriction.

26. The valve assembly of claim 24, wherein the groove extends in a slaloming pattern.

27. The valve assembly of claim 24, wherein the channel inlet comprises at least one inlet opening defined in an inner surface of the valve sleeve, the at least one inlet opening being in fluid communication with the groove, and wherein the single fluid channel comprises a channel outlet defined by the portion of the groove aligned with the fluid port.

28. The valve assembly of claim 24, wherein the single fluid channel includes an inlet chamber defined in the outer surface of the valve sleeve, the inlet chamber being in fluid communication with the groove and being sized and configured to mitigate intake of undesired material into the groove.

* * * * *